US012044116B1

(12) United States Patent
Dyngosz et al.

(10) Patent No.: US 12,044,116 B1
(45) Date of Patent: Jul. 23, 2024

(54) GEOMECHANICAL DATA INTERPRETATION AND RECOMMENDATION SYSTEM USING LARGE LANGUAGE MODELS

(71) Applicant: Halliburton Energy Services, Inc., Houston, TX (US)

(72) Inventors: Mateusz Michal Dyngosz, Houston, TX (US); Claudia Lucia Bonin De Oliveira, Houston, TX (US); Dale E. Jamison, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/221,997

(22) Filed: Jul. 14, 2023

(51) Int. Cl.
*E21B 44/00* (2006.01)

(52) U.S. Cl.
CPC ..... *E21B 44/00* (2013.01); *E21B 2200/20* (2020.05); *E21B 2200/22* (2020.05)

(58) Field of Classification Search
CPC ... E21B 44/00; E21B 2200/20; E21B 2200/22
USPC ..... 703/10
See application file for complete search history.

(56) References Cited

U.S. PATENT DOCUMENTS

| | | | | |
|---|---|---|---|---|
| 8,682,478 | B2 | 3/2014 | Kechel | |
| 11,053,792 | B2 * | 7/2021 | Williams | E21B 21/08 |
| 11,085,273 | B2 * | 8/2021 | Williams | G06F 30/28 |
| 11,091,989 | B1 * | 8/2021 | De Oliveira | E21B 49/005 |
| 11,893,341 | B2 * | 2/2024 | Itani | G06F 16/38 |
| 11,966,845 | B1 * | 4/2024 | Dyngosz | G06N 3/08 |
| 2010/0046842 | A1 * | 2/2010 | Conwell | G06F 18/24 382/218 |
| 2010/0228693 | A1 * | 9/2010 | Dawson | G06N 5/022 707/769 |
| 2013/0251237 | A1 | 9/2013 | Cao et al. | |
| 2017/0342808 | A1 * | 11/2017 | Dykstra | E21B 44/06 |
| 2018/0114158 | A1 * | 4/2018 | Foubert | E21B 44/00 |
| 2018/0238164 | A1 * | 8/2018 | Jamison | G06N 3/047 |
| 2019/0171187 | A1 * | 6/2019 | Cella | G06N 3/126 |
| 2019/0292908 | A1 * | 9/2019 | Karimi Vajargah | E21B 49/00 |
| 2020/0040719 | A1 * | 2/2020 | Maniar | E21B 41/00 |

(Continued)

OTHER PUBLICATIONS

Hoffimann et al. (Sequence Mining and Pattern Analysis in Drilling Reports with Deep Natural Language Processing, arXiv, 2017, pp. 1-7) (Year: 2017).*

(Continued)

*Primary Examiner* — Iftekhar A Khan
(74) *Attorney, Agent, or Firm* — Michael Jenney; C. Tumey Law Group PLLC

(57) ABSTRACT

A method may include providing one or more inputs to a hybrid data generator, wherein one of the one or more inputs is based at least in part on a wellsite location, wherein the hybrid data generator comprises a large language model, and wherein the large language model is based at least in part on a machine learning algorithm. The method may further include utilizing an information handling system to generate a drilling program based at least in part on the one or more inputs and the hybrid data generator. The method may further include performing at least a portion of a drilling operation based at least in part on the drilling program and collecting at least one measurement from at least one sensor during the drilling operation.

20 Claims, 9 Drawing Sheets

(56) References Cited

U.S. PATENT DOCUMENTS

| | | | | |
|---|---|---|---|---|
| 2020/0110589 | A1* | 4/2020 | Bequet | G06F 16/164 |
| 2020/0356726 | A1* | 11/2020 | Nelson | G06F 40/211 |
| 2021/0005195 | A1* | 1/2021 | Tao | G06F 40/216 |
| 2021/0133387 | A1* | 5/2021 | Ramchune | G06F 16/34 |
| 2021/0165963 | A1* | 6/2021 | Mendes | G06F 40/279 |
| 2021/0180439 | A1* | 6/2021 | Rawlinson | G06N 5/01 |
| 2021/0238938 | A1* | 8/2021 | Jamison | E21B 47/06 |
| 2022/0084515 | A1* | 3/2022 | Chatar | G10L 15/22 |
| 2022/0205350 | A1* | 6/2022 | Santana | G06F 18/214 |
| 2022/0222401 | A1* | 7/2022 | Atkins | G06N 3/08 |
| 2022/0316310 | A1* | 10/2022 | Mohsenian | E21B 43/25 |
| 2022/0341292 | A1* | 10/2022 | Bayraktar | G01V 20/00 |
| 2022/0397029 | A1* | 12/2022 | Wicks | G06N 3/092 |
| 2023/0082520 | A1* | 3/2023 | Jan | E21B 7/00 702/6 |
| 2024/0004424 | A1* | 1/2024 | Wickersham | B33Y 50/00 |

OTHER PUBLICATIONS

Lashari et al. (Drilling performance monitoring and optimization: a data-driven approach, Journal of Petroleum Exploration and Production Technology (2019) 9:2747-2756) (Year: 2019).*

Jaini et al. (Indirect tool monitoring in drilling based on gap sensor signal and multilayer perceptron feed forward neural network, Journal of Intelligent Manufacturing (2021) 32:1605-1619) (Year: 2021).*

* cited by examiner

GEOMECHANICAL DATA INTERPRETATION AND RECOMMENDATION SYSTEM USING LARGE LANGUAGE MODELS

BACKGROUND

The oil and gas industry may use wellbores as fluid conduits to access subterranean deposits of various fluids and minerals which may include hydrocarbons. A drilling operation may be utilized to construct the fluid conduits which are capable of producing hydrocarbons disposed in subterranean formations. Wellbores may be incrementally constructed as tapered sections, which sequentially extend into a subterranean formation. The widest diameter sections may be located near the surface of the earth while the narrowest diameter sections may be disposed at the toe of the well. For example, starting at the surface of the earth, the borehole sections which make up a wellbore may include any combination of a conductor borehole, one or more surface boreholes, one or more intermediate boreholes, a pilot borehole, and/or a production borehole. The diameter of the foregoing wellbore sections may sequentially decrease in diameter from the conductor borehole to the production borehole. In some examples, the design, operational, equipment, and fluid parameters may be different for each borehole section. Prior to executing a drilling operation, it may be beneficial to construct a drilling plan which incorporates multi-disciplinary data including engineering and geological data.

BRIEF DESCRIPTION OF THE DRAWINGS

These drawings illustrate certain aspects of some examples of the present disclosure and should not be used to limit or define the disclosure.

DETAILED DESCRIPTION

Figure 1:
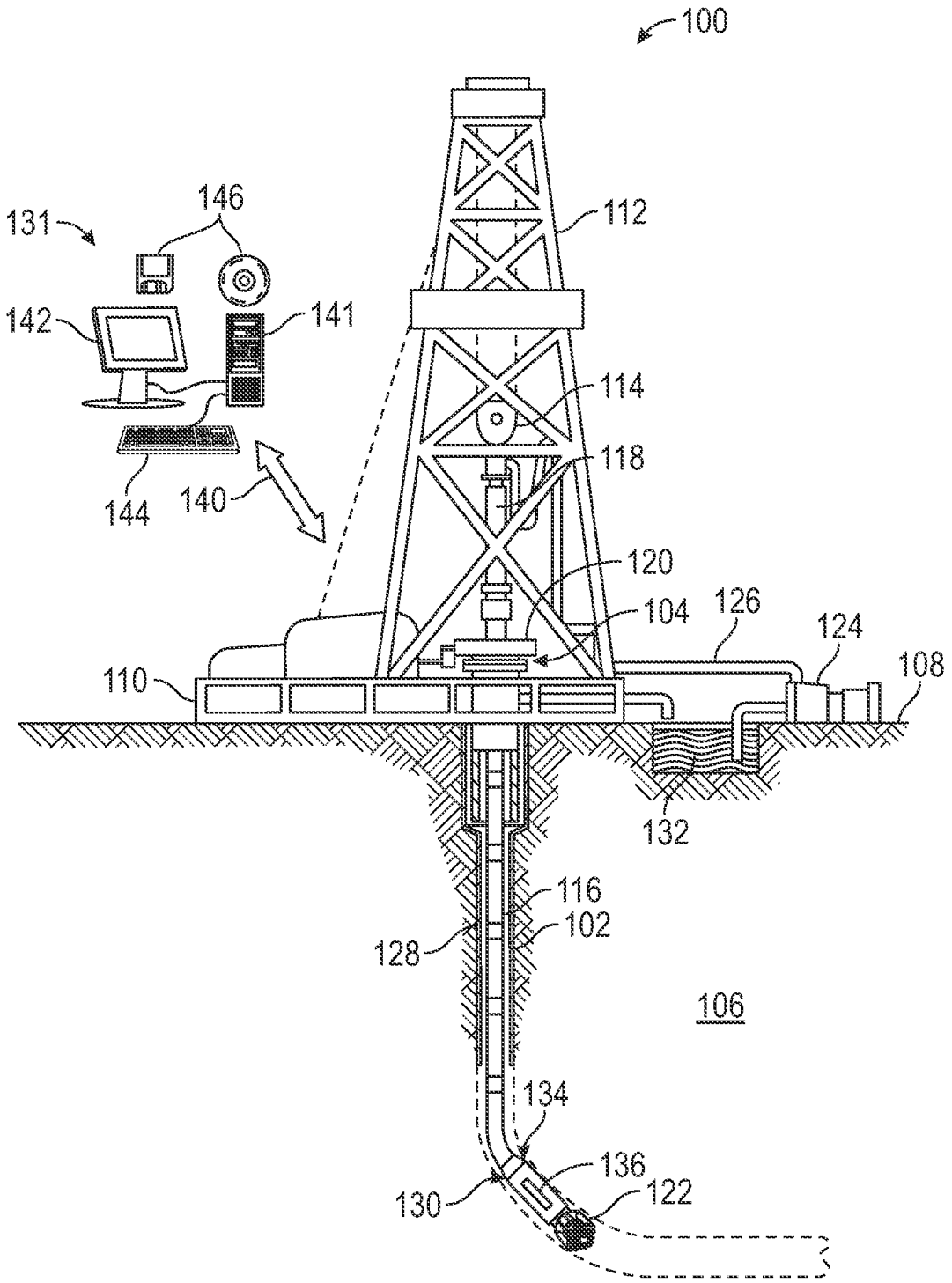
FIG. 1 illustrates an example of a drilling system and operation.

This disclosure details methods and systems which utilize hybrid data generators which may include at least a Large Language Model ("LLMs") to aid in the creation of drilling programs which may be used to construct subterranean wellbores. In general, the hybrid data generator may include a stack of models which are run in series, in parallel, and combinations thereof to produce a drilling program. Since a drilling program may include text-based data, one of the models which may be included in the model stack of a hybrid data generator may include a Large Language Model. In some examples, Large Language Models, which may be a type of empirical model, may be adept at interpreting text-based inputs and providing coherent and informative text-based outputs. The additional models included in the model stack for a hybrid data generator may include any one or more of physics-based models, empirical models generated from a priori data, cost models, material supply models, and combinations thereof. Some of the empirical models included in the model stack may be built on machine learning and/or deep learning algorithms which may be able to handle datasets which are orders of magnitudes larger than either manual analysis or physics-based analysis, alone. For example, some of the models included in the model stack of a hybrid data generator may be used to analyze and identify relationships between drilling performance and historical data. While drilling performance may be assessed in a multitude of ways, some of the common ways the performance of a drilling operation may be assessed include the time spent to construct the wellbore, the cost of wellbore construction, how closely the constructed wellbore reflects the planned wellbore, and safely the operations were performed during wellbore construction. The historical data may include independent values which may impact the performance of a drilling operation. In many cases, the historical data may include a multi-disciplinary dataset.

In some examples, historical multi-disciplinary datasets may be used to at least partially inform future wellbore construction and drilling operations by being at least partially incorporated into a drilling program which may be used to construct a subterranean formation. For example, multi-disciplinary datasets may at least partially inform components of a drilling program including borehole design (e.g., alternatively wellbore design), cement designs, operational plans, equipment utilized for the wellbore construction, fluid parameters, and/or hydraulic calculations. The multi-disciplinary datasets may further include information from technical fields including engineering design, geology, geophysics, and operational execution. For example, multi-disciplinary datasets may include at least one or more of engineering data, geological data, geo-mechanical data, geophysical data, data from lab-based tests, data modelled from simulations, data modelled from empirical models, data modelled from physics-based models, data from physics-informed neural networks ("PINNs"), operational data from current drilling operations, operational data from previous drilling operations, measurements collected from current drilling operations, measurements collected from previous drilling operations, information collected from previous drilling reports, previously created drilling plans, logging data, available equipment in a given region, and combinations thereof. In addition to the foregoing datasets, information from public datasets including the National Oceanic and Atmospheric Administration ("NOAA"), public geological databases, weather databases and models, traffic and road restriction information, and combinations thereof may be included in the multi-disciplinary datasets.

In some examples, the borehole design may include a starting and ending depth of each borehole section, a diameter of each borehole section, a casing setting depth of each section, and/or any information related to one or more trajectories in which the borehole section should be extended (e.g., a directional plan including azimuth, inclination, dogleg severity, build rate, and/or walk rate), bottom hole assembly design ("BHA" design), bit design, bit plans (e.g., when bits are to be changed out), fluid compositions and fluid designs, cementing designs, completions designs, and combinations thereof. In some non-limiting examples, the borehole design may at least partially account for the one or more types of rock that are encountered in the subterranean formation, the one or more pore pressures of the various rock layers in the subterranean formation, the stresses and forces of the subterranean formation (e.g., basin stresses), and the stability of the rocks in the subterranean formation. In some non-limiting examples, the operational plans may include operational or engineering parameters including one or more rates of penetration ("ROP"), one or more circulating rates of the drilling fluid, one or more values for weight on bit ("WOB"), one or more values for drilling torque, one or more mud compositions, one or more drill bit designs, one or more values for drill bit revolutions per minute ("RPM"), and/or any operations related to replacing equipment as the operation progresses. In some examples, the casing setting depths may change as a function of the engineering parameters. In some examples, calculations such as mechanical specific energy or specific mechanical energy ("SME") may be at least partially used to guide the operational plans.

In some non-limiting examples, the utilized equipment may include rigs, drill pipe, spiraled drill pipe, drilling collars, reamers, casing and liners, isolation plugs and/or packers, casing patches, cementing equipment, wellbore logging equipment, drill bits, mills and milling assemblies, cutting tools and cutting assemblies, centrifuges, degassers, desanders, and various measurement devices and sensors which may be disposed on any portion of the drilling and/or wellbore equipment. In further examples, measurement devices and sensors may be included in or on a bottom hole assembly ("BHA"), which may be disposed at the distal end of the drill string, towards the drill bit of cutting assemblies. Additional equipment utilized during drilling and wellbore construction operations will be described further below. In some non-limiting examples, the fluid parameters may include components for drilling mud and other drilling treatment fluids such as base fluids (e.g., water-based fluids, invert emulsions, and direct emulsions), clay (e.g., bentonite), weighting agents (e.g., barite), chemical additives (e.g., shale inhibitors, scale inhibitors, flocculants, foaming agents, stabilizers, surfactants, emulsifiers, and/or friction reducers), lost circulation materials, completions fluids, and other circulating fluids. In further examples, the fluid parameters may include loadings for the planning drilling fluid components and additives.

As previously mentioned, drilling performance may be assessed in a multitude of ways. In some examples, a range of drilling programs may be created from which a drilling program may be selected for execution. In some non-limiting examples, operational features which may be utilized to assess drilling performance and optimize a drilling program may include maximizing rate of penetration, maximizing hole cleaning, maximizing hole stability, minimizing total drilling cost, minimizing cost per wellbore section, minimizing time spent on each wellbore section, and combinations thereof. In some examples, drilling programs generated by hybrid data generators may include constraints which optimize a drilling program for a single operational feature or a weighted set of operational features. As such, the one or more drilling programs, which may at least partially be generated by hybrid data generators, may be optimized with respect to one or more target objectives or operational features.

In some examples, drilling operations may be time sensitive operations. In further examples, it may be time consuming for a human to identify, analyze, and incorporate all relevant data into an initial drilling program in a timely manner. Additionally, it may be desirable to update drilling programs during the drilling operations, however time constraints may restrict the breadth and depth of analysis that may be performed using current methods to generate the updated drilling program. The foregoing may be true despite the use of currently available automatic and/or semi-automatic tools which may be implemented on an information handling system to analyze, compile, organize, and/or structure some of the datasets. Additionally, analysis of the available data may require subject matter expertise for adequate analysis and development of the drilling program. In some examples, impactful relationships between independent variables in a multi-disciplinary dataset and the drilling performance may not yet have been identified.

Given the time constraints and analytical constraints imposed by the current methods, it may be beneficial to utilize a hybrid data generator to generate drilling programs. The drilling programs may at least partially guide the construction of a subterranean wellbore. In some examples, hybrid data generators which utilize Large Language Models, may be able to generate initial and updated drilling programs at a faster pace than the traditional processes. As previously mentioned, traditional processes utilized to develop drilling programs may include manual processes, partially automated processes, fully automated processes, and combinations thereof. However, traditional processes may not have previously used hybrid data generators which utilize Large Language Models. In further examples, utilizing hybrid data generators may allow for humans, including subject matter experts, to develop and update drilling programs in a more efficient manner. For example, with the benefit of drilling programs constructed from hybrid data generators, personnel may spend less time generating drilling programs and more time reviewing and optimizing drilling programs while reducing the overall time required to generate an adequate drilling program. As such, the use of hybrid data generators which may be at least partially supported by Large Language Models, may be beneficial to the process of creating drilling programs.

FIG. 1 illustrates an example of drilling system 100. The operations of drilling system 100 may be guided by a drilling program. In some examples, an initial drilling program may be generated prior to moving any drilling equipment to a wellsite location. In other examples, an initial drilling program may be generated prior to initiating a conductor borehole or a surface borehole. In further examples, the drilling program may be generated from a hybrid data generator which may further utilize a Large Language Model, physical models, empirical models, cost models, material supply models, and/or combinations thereof. As illustrated, wellbore 102 may extend from a wellhead 104 into a subterranean formation 106 from a surface 108. In some examples, wellbore 102 may be constructed based at least in part on a drilling program. Generally, wellbore 102 may include horizontal, vertical, slanted, curved, and other types of wellbore geometries and orientations. Wellbore 102 may be cased or uncased. In examples, wellbore 102 may include a metallic member. By way of example, the metallic member may be a casing, liner, tubing, or other elongated steel tubular disposed in wellbore 102.

As illustrated, wellbore 102 may extend through subterranean formation 106. As illustrated in FIG. 1, wellbore 102 may extend generally vertically into the subterranean formation 106, however, wellbore 102 may extend at an angle through subterranean formation 106, such as horizontal and slanted wellbores. It should further be noted that while FIG. 1 generally depicts land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may include, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor, a rotary steerable system ("RSS"), and/or via rotation of drill string 116 from surface 108. Without limitation, drill bit 122 may include, roller cone bits, PDC bits, natural diamond bits, any hole openers, reamers, coring bits, cutting assemblies, and the like. As drill bit 122 rotates, it may create and extend wellbore 102 that penetrates various subterranean formations 106. In some examples, the rotational speed of the drill bit may be an operational parameter or an engineering parameter. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132. In some examples, the rate at which the drilling fluid is circulated may at least partially affect the efficacy of removing drill cuttings from the wellbore or borehole. As such, in some examples, the rate at which the drilling fluid is circulated may be an engineering parameter or an operational parameter. In some examples, the drilling fluid may include drilling mud which may further include a base fluid and additives. The base fluid may be a water-based fluid, invert emulsion, or a direct emulsion. The additives may include clay (e.g., bentonite), weighting agents (e.g., barite), chemical additives (e.g., shale inhibitors, scale inhibitors, flocculants, foaming agents, stabilizers, surfactants, emulsifiers, and/or friction reducers), lost circulation material, fluid loss material, lubricants, viscosifiers, thinners, and combinations thereof. During drilling operations and wellbore construction operations, parameters associated with the drilling fluid may be measured and/or recorded by sensors and/or devices. In some non-limiting examples, the drilling fluid parameters may include fluid density (e.g., in pounds per gallon or ppg), fluid viscosity (e.g., six-speed rheology conducted at operating pressure and temperature), fluid temperature, high-weight solids content, low-weight solids content, oil-water ratio, electric stability, chlorides concentration, calcium concentration, concentration of inhibitors, low-end rheology, fluid loss, water salinity and water phase salinity, salt type and concentration, particle size distribution (e.g., of solid additives including but not limited to lost circulation material), and combinations thereof. In some examples, the properties of a drilling fluid may change as the wellbore is extended into the subterranean formation. In further examples, adjustments may be may to the drilling fluid composition in order to maintain a set of drilling fluid properties. In some examples, the drilling fluid properties may impact drilling performance. As such, monitoring and adjusting the drilling fluid properties while the drilling operation is occurring may allow for improved and/or optimized drilling performance. In some examples, large language models may be used to analyze prior well performance and identify fluid designs which may be beneficial for a drilling a given portion of a subterranean formation.

With continued reference to FIG. 1, drill string 116 may begin at wellhead 104 and may traverse wellbore 102. Drill bit 122 may be attached to a distal end of drill string 116 and may be driven, for example, either by a downhole motor and/or via rotation of drill string 116 from surface 108. In a non-limiting example, the weight of drill string 116 and bottom hole assembly may be controlled and measured while drill bit 122 is disposed within wellbore 102. In further examples, drill bit 122 may or may not be in contact with the bottom of wellbore 102. Drill bit 122 may be allowed to contact the bottom of wellbore 102 with varying amounts of weight applied to drill bit 122. The weight of drill string 116 may be measured at the surface of wellbore 102 and may be referred to as the "hook load." The difference in the hook load when drill bit 122 is suspended just above the bottom of wellbore 102 and the hook load when drill bit 122 is in contact with the bottom of wellbore 102 may be referred to as the weight-on-bit ("WOB"). Both the hook load and the weight-on-bit may be considered operational parameters and/or engineering parameters. In some examples the hook load may be measured by a hoisting system or a hook load sensor. In some examples, the hook load is measured at the surface by a sensor disposed at the surface of drilling system 100.

Drill bit 122 may be a part of bottom hole assembly 130 at the distal end of drill string 116. In some examples, bottom hole assembly 130 may further include tools for directional drilling applications. In other examples, directional drilling tools may be disposed anywhere along the drill string assembly. In further examples, directional drilling tools may be disposed within the wellbore using wireline, electric line, or slick line. As will be appreciated by those of ordinary skill in the art, bottom hole assembly 130 may include drilling equipment and directional drilling tools including but not limited to a measurement-while drilling (MWD) and/or logging-while drilling (LWD) system, magnetometers, accelerometers, agitators, bent subs, orienting subs, mud motors, rotary steerable systems (RSS), jars, vibration reduction tools, roller reamers, pad pushers, non-magnetic drilling collars, whipstocks, push-the-bit systems, point-the-bit systems, directional steering heads and other directional drilling tools. Directional drilling tools may be disposed anywhere along the drill string assembly including at the portion distal to the drilling right which may be known as the Bottom hole assembly 130 may comprise any number of tools, transmitters, and/or receivers to perform downhole measurement operations. In some scenarios, these downhole measurements produce drilling parameters which may be used to guide the drilling operation. For example, as illustrated in FIG. 1, bottom hole assembly 130 may include a measurement assembly 134. It should be noted that measurement assembly 134 may make up at least a part of bottom hole assembly 130. Without limitation, any number of different measurement assemblies, communication assemblies, battery assemblies, and/or the like may form bottom hole assembly 130 with measurement assembly 134. Additionally, measurement assembly 134 may form bottom hole assembly 130 itself. In examples, measurement assembly 134 may comprise at least one sensor 136, which may be disposed at the surface of measurement assembly 134. It should be noted that while FIG. 1 illustrates a single sensor 136, there may be any number of sensors disposed on or within measurement assembly 134. Without limitation, sensors may be referred to as a transceiver. Further, it should be noted that there may be any number of sensors disposed along bottom hole assembly 130 at any degree from each other. In examples, sensors 136 may also include backing materials and matching layers. It should be noted that sensors 136 and assemblies housing sensors 136 may be removable and replaceable, for example, in the event of damage or failure.

Without limitation, bottom hole assembly 130 may be connected to and/or controlled by information handling system 131, which may be disposed on surface 108. Without limitation, information handling system 131 may be disposed down hole in bottom hole assembly 130. In addition to the sensors and measurement devices disposed on bottom hole assembly 130, information handling system 131 may be connected to sensors disposed on any other piece of equipment used in drilling system 100 including sensors disposed on the drilling platform 110, derrick 112, drill string 116, pumps 124, retention pit 132, wellhead 104, and sensors disposed within the wellbore 102 which are not connected to the drill string 116 or bottom hole assembly 130. Processing of information recorded may occur down hole and/or on surface 108. Processing occurring downhole may be transmitted to surface 108 to be recorded, observed, and/or further analyzed. Additionally, information recorded on information handling system 131 that may be disposed down hole may be stored until bottom hole assembly 130 may be brought to surface 108. In examples, information handling system 131 may communicate with bottom hole assembly 130 through a communication line (not illustrated) disposed in (or on) drill string 116. In examples, wireless communication may be used to transmit information back and forth between information handling system 131 and bottom hole assembly 130. Information handling system 131 may transmit information to bottom hole assembly 130 and may receive as well as process information recorded by bottom hole assembly 130. In examples, a downhole information handling system (not illustrated) may include, without limitation, a microprocessor or other suitable circuitry, for estimating, receiving, and processing signals from bottom hole assembly 130. Downhole information handling system (not illustrated) may further include additional components, such as memory, input/output devices, interfaces, and the like. In examples, while not illustrated, bottom hole assembly 130 may include one or more additional components, such as analog-to-digital converter, filter, and amplifier, among others, that may be used to process the measurements of bottom hole assembly 130 before they may be transmitted to surface 108. Alternatively, raw measurements from bottom hole assembly 130 may be transmitted to surface 108.

Any suitable technique may be used for transmitting signals from bottom hole assembly 130 to surface 108, including, but not limited to, wired pipe telemetry, mud-pulse telemetry, acoustic telemetry, and electromagnetic telemetry. While not illustrated, bottom hole assembly 130 may include a telemetry subassembly that may transmit telemetry data to surface 108. At surface 108, pressure sensors (not shown) may convert the pressure signal into electrical signals for a digitizer (not illustrated). The digitizer may supply a digital form of the telemetry signals to information handling system 131 via a communication link 140, which may be a wired or wireless link. The telemetry data may be analyzed and processed by information handling system 131. In some examples, information handling system 131 may be configured to update a hybrid data generator to generate an updated drilling program based on the measurements gathered from the various sensors disposed on the drilling equipment. In some examples, threshold values set for various drilling parameters, engineering parameters, operational parameters, and/or fluid parameters, which may be measured by any one or more of the sensors disposed within the drilling operation, may trigger the hybrid data generator to generate an updated drilling program. In further examples, the information handling system may be configured to update the hybrid data generator such that the drilling program is updated continuously, at set intervals, at random intervals, by manual execution as determined by personnel, when a threshold is met for any one or more parameters as described above, or combinations thereof. In some examples, manual input may be provided which may be utilized to update the hybrid data generator. In further examples the updated drilling program may be automatically implemented or may require review and approval by personnel prior to implementation.

As illustrated, communication link 140 (which may be wired or wireless, for example) may be provided that may transmit data from bottom hole assembly 130 to an information handling system 131 at surface 108. Information handling system 131 may include a personal computer 141, a video display 142, a keyboard 144 (i.e., other input devices), and/or non-transitory computer-readable media 146 (e.g., optical disks, magnetic disks) that can store code representative of the methods described herein. In addition to, or in place of processing at surface 108, processing may occur downhole. As will be discussed below, the hybrid data generator may be executed on information handling system 131, both before drilling operations commence, while drilling operations are occurring, or during periods where drilling operations are stalled, to generate an initial and/or an updated drilling program.

Information handling system 131 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 131 may be a personal computer, a network storage device, or any other suitable device and may vary in size, shape, performance, functionality, and price. Information handling system 131 may include random access memory (RAM), one or more processing resources such as a central processing unit (CPU) or hardware or software control logic, ROM, and/or other types of nonvolatile memory. Additional components of the information handling system 131 may include one or more disk drives 146, output devices 142, such as a video display, and one or more network ports for communication with external devices as well as an input device 144 (e.g., keyboard, mouse, etc.). Information handling system 131 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2:
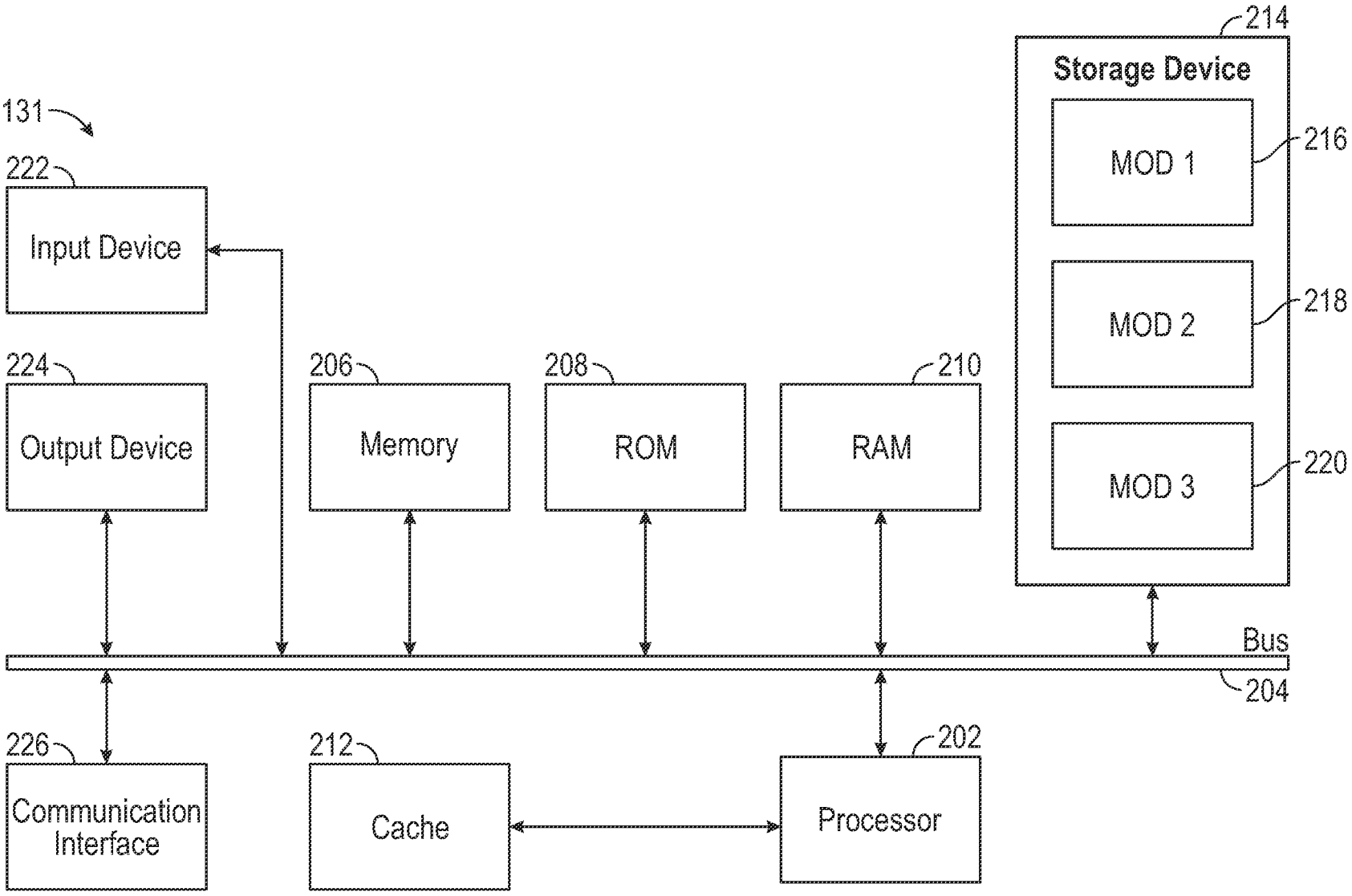
FIG. 2 illustrates is a schematic view of an information handling system.

FIG. 2 illustrates an example information handling system 131 which may be employed to perform various steps, methods, and techniques disclosed herein. Persons of ordinary skill in the art will readily appreciate that other system examples are possible. As illustrated, information handling system 131 includes a processing unit (CPU or processor) 202 and a system bus 204 that couples various system components including system memory 206 such as read only memory (ROM) 208 and random-access memory (RAM) 210 to processor 202. Processors disclosed herein may all be forms of this processor 202. Information handling system 131 may include a cache 212 of high-speed memory connected directly with, in close proximity to, or integrated as part of processor 202. Information handling system 131 copies data from memory 206 and/or storage device 214 to cache 212 for quick access by processor 202. In this way, cache 212 provides a performance boost that avoids processor 202 delays while waiting for data. These and other modules may control or be configured to control processor 202 to perform various operations or actions. Other system memory 206 may be available for use as well. Memory 206 may include multiple different types of memory with different performance characteristics. It may be appreciated that the disclosure may operate on information handling system 131 with more than one processor 202 or on a group or cluster of computing devices networked together to provide greater processing capability. Processor 202 may include any general-purpose processor and a hardware module or software module, such as first module 216, second module 218, and third module 220 stored in storage device 214, configured to control processor 202 as well as a special-purpose processor where software instructions are incorporated into processor 202. Processor 202 may be a self-contained computing system, containing multiple cores or processors, a bus, memory controller, cache, etc. A multi-core processor may be symmetric or asymmetric. Processor 202 may include multiple processors, such as a system having multiple, physically separate processors in different sockets, or a system having multiple processor cores on a single physical chip. Similarly, processor 202 may include multiple distributed processors located in multiple separate computing devices but working together such as via a communications network. Multiple processors or processor cores may share resources such as memory 206 or cache 212 or may operate using independent resources. Processor 202 may include one or more state machines, an application specific integrated circuit (ASIC), or a programmable gate array (PGA) including a field PGA (FPGA).

Each individual component discussed above may be coupled to system bus 204, which may connect each and every individual component to each other. System bus 204 may be any of several types of bus structures including a memory bus or memory controller, a peripheral bus, and a local bus using any of a variety of bus architectures. A basic input/output (BIOS) stored in ROM 208 or the like, may provide the basic routine that helps to transfer information between elements within information handling system 131, such as during start-up. Information handling system 131 further includes storage devices 214 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 214 may include software modules 216, 218, and 220 for controlling processor 202. Information handling system 131 may include other hardware or software modules. Storage device 214 is connected to the system bus 204 by a drive interface. The drives and the associated computer-readable storage devices provide nonvolatile storage of computer-readable instructions, data structures, program modules and other data for information handling system 131. In one aspect, a hardware module that performs a particular function includes the software component stored in a tangible computer-readable storage device in connection with the necessary hardware components, such as processor 202, system bus 204, and so forth, to carry out a particular function. In another aspect, the system may use a processor and computer-readable storage device to store instructions which, when executed by the processor, cause the processor to perform operations, a method or other specific actions. For example, the hybrid data generator, which may include a Large Language Model or other models derived from machine learning- and deep learning algorithms, may include computational instructions which may be executed on a processor to generate an initial and/or an updated drilling program. In some examples, the deep learning algorithms may include convolutional neural networks, long short term memory networks, recurrent neural networks, generative adversarial networks, attention neural networks, zero-shot models, fine-tuned models, domain-specific models, multi-modal models, transformer architectures, radial basis function networks, multilayer perceptrons, self-organizing maps, deep belief networks, and combinations thereof. The basic components and appropriate variations may be modified depending on the type of device, such as whether information handling system 131 is a small, hand-held computing device, a desktop computer, or a computer server. When processor 202 executes instructions to perform "operations", processor 202 may perform the operations directly and/or facilitate, direct, or cooperate with another device or component to perform the operations.

As illustrated, information handling system 131 employs storage device 214, which may be a hard disk or other types of computer-readable storage devices which may store data that are accessible by a computer, such as magnetic cassettes, flash memory cards, digital versatile disks (DVDs), cartridges, random access memories (RAMs) 210, read only memory (ROM) 208, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 131, an input device 222 represents any number of input mechanisms, such as a microphone for speech, a touch-sensitive screen for gesture or graphical input, keyboard, mouse, motion input, speech and so forth. An output device 224 may also be one or more of a number of output mechanisms known to those of skill in the art. In some instances, multimodal systems enable a user to provide multiple types of input to communicate with information handling system 131. Communications interface 226 generally governs and manages the user input and system output. There is no restriction on operating on any particular hardware arrangement and therefore the basic hardware depicted may easily be substituted for improved hardware or firmware arrangements as they are developed.

As illustrated, each individual component describe above is depicted and disclosed as individual functional blocks. The functions these blocks represent may be provided through the use of either shared or dedicated hardware, including, but not limited to, hardware capable of executing software and hardware, such as a processor 202, that is purpose-built to operate as an equivalent to software executing on a general-purpose processor. For example, the functions of one or more processors presented in FIG. 2 may be provided by a single shared processor or multiple processors. (Use of the term "processor" should not be construed to refer exclusively to hardware capable of executing software.) Illustrative examples may include microprocessor and/or digital signal processor (DSP) hardware, read-only memory (ROM) 208 for storing software performing the operations described below, and random-access memory (RAM) 210 for storing results. Very large-scale integration (VLSI) hardware examples, as well as custom VLSI circuitry in combination with a general-purpose DSP circuit, may also be provided.

Figure 3:
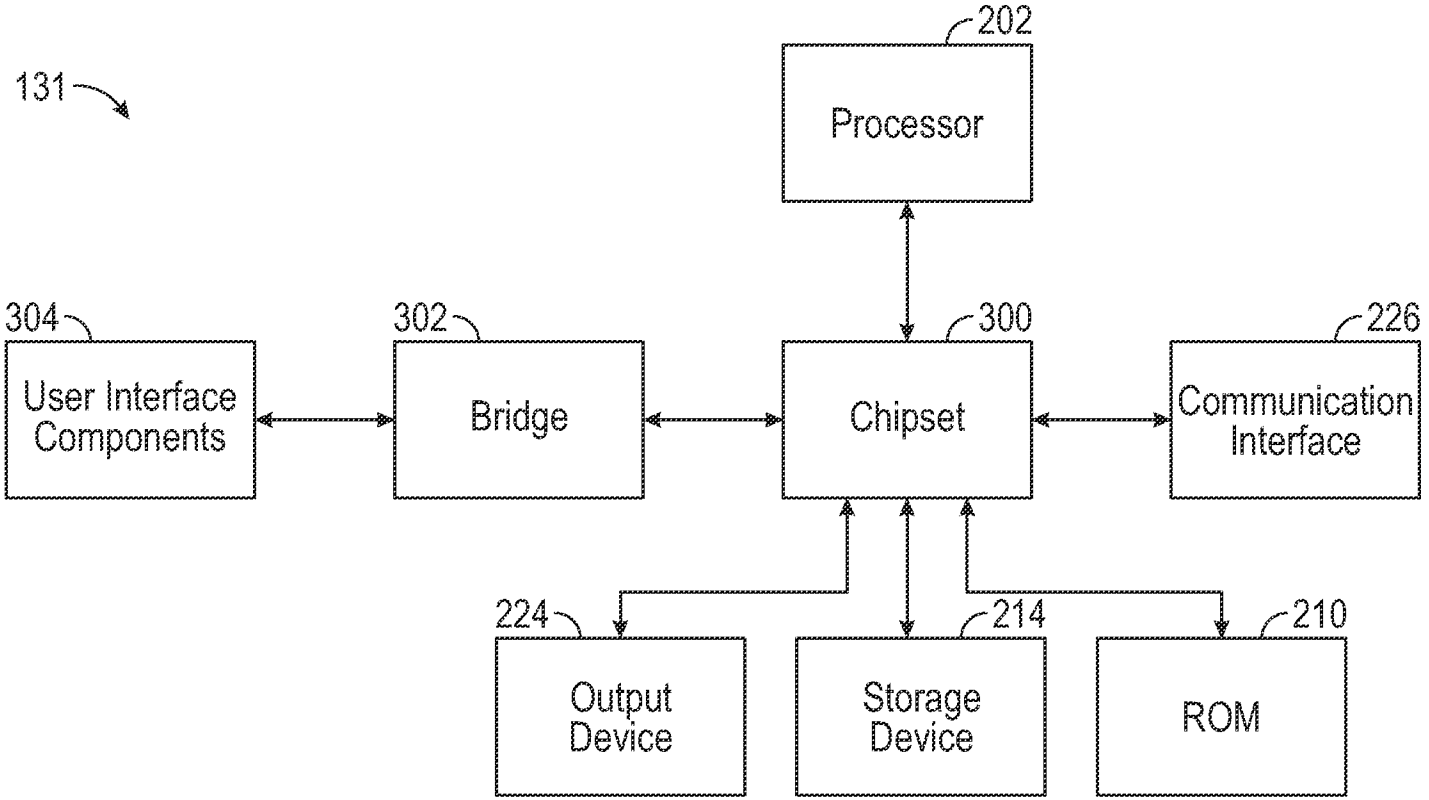
FIG. 3 illustrates another schematic view of and information handling system.

FIG. 3 illustrates an example information handling system 131 having a chipset architecture that may be used in executing the described method and generating and displaying a graphical user interface (GUI). Information handling system 131 is an example of computer hardware, software, and firmware that may be used to implement the disclosed technology. Information handling system 131 may include a processor 202, representative of any number of physically and/or logically distinct resources capable of executing software, firmware, and hardware configured to perform identified computations. Processor 202 may communicate with a chipset 300 that may control input to and output from processor 202. In this example, chipset 300 outputs information to output device 224, such as a display, and may read and write information to storage device 214, which may include, for example, magnetic media, and solid-state media. Chipset 300 may also read data from and write data to RAM 210. A bridge 302 for interfacing with a variety of user interface components 304 may be provided for interfacing with chipset 300. Such user interface components 304 may include a keyboard, a microphone, touch detection and processing circuitry, a pointing device, such as a mouse, and so on. In general, inputs to information handling system 131 may come from any of a variety of sources including machine generated and/or human generated.

Chipset 300 may also interface with one or more communication interfaces 226 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 202 analyzing data stored in storage device 214 or RAM 210. Further, information handling system 131 may receive one or more inputs from a user via user interface components 304 and execute appropriate functions, such as browsing functions by interpreting these inputs using processor 202.

In examples, information handling system 131 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

During drilling operations, information handling system 131 may process different types of the real time data originated from varied sampling rates and various sources, such as diagnostics data, sensor measurements, operations data, and/or the like. These one or more measurements from wellbore 102, BHA 130, measurement assembly 134, and sensor 136 may allow for information handling system 131 to perform real-time health assessment of the drilling operation. In some examples, the foregoing one or more measurements may be utilized to generate an updated drilling program when the one or more measurements are supplied to the hybrid data generator. Drilling tools and equipment may further comprise a variety of sensors which may be able to provide one or more real-time measurements and data relevant to steering the wellbore in adherence to a well plan. In some examples this drilling equipment may include drilling rigs, top drives, drilling tubulars, mud motors, gyroscopes, accelerometers, magnetometers, bent housing subs, directional steering heads, rotary steerable systems ("RSS"), whipstocks, push-the-bit systems, point-the-bit systems, and other directional drilling tools. In the context of drilling operations, "real-time," may be construed as monitoring, gathering, assessing, and/or utilizing data contemporaneously with the execution of the drilling operation. Real-time operations may further comprise modifying the initial design or execution of the planned operation in order to modify a well plan of a drilling operation. In some examples, the modifications to the drilling operation may occur through automated or semi-automated processes. An example of an automated drilling process may include relaying or downlinking a set of operational commands (control commands) to an RSS in order to modify a drilling operation to achieve a certain objective. In other examples, operational commands (control commands), which may be derived from an initial or an updated drilling program may be automatically relayed to the top drive. In other examples, the operational commands (control commands) may be relayed to the rig personnel for review prior to implementation. In some examples, one or more drilling objectives and operational features may be incorporated into the drilling operation through the utilization of a cost function. In further examples, the cost function may be optimized for one or more operational features including but not limited to maximizing rate of penetration, maximizing hole cleaning, maximizing hole stability, operational safety, minimizing total drilling cost, minimizing operational time per hole section, minimizing cost per hole section, and combinations thereof.

Figure 4:
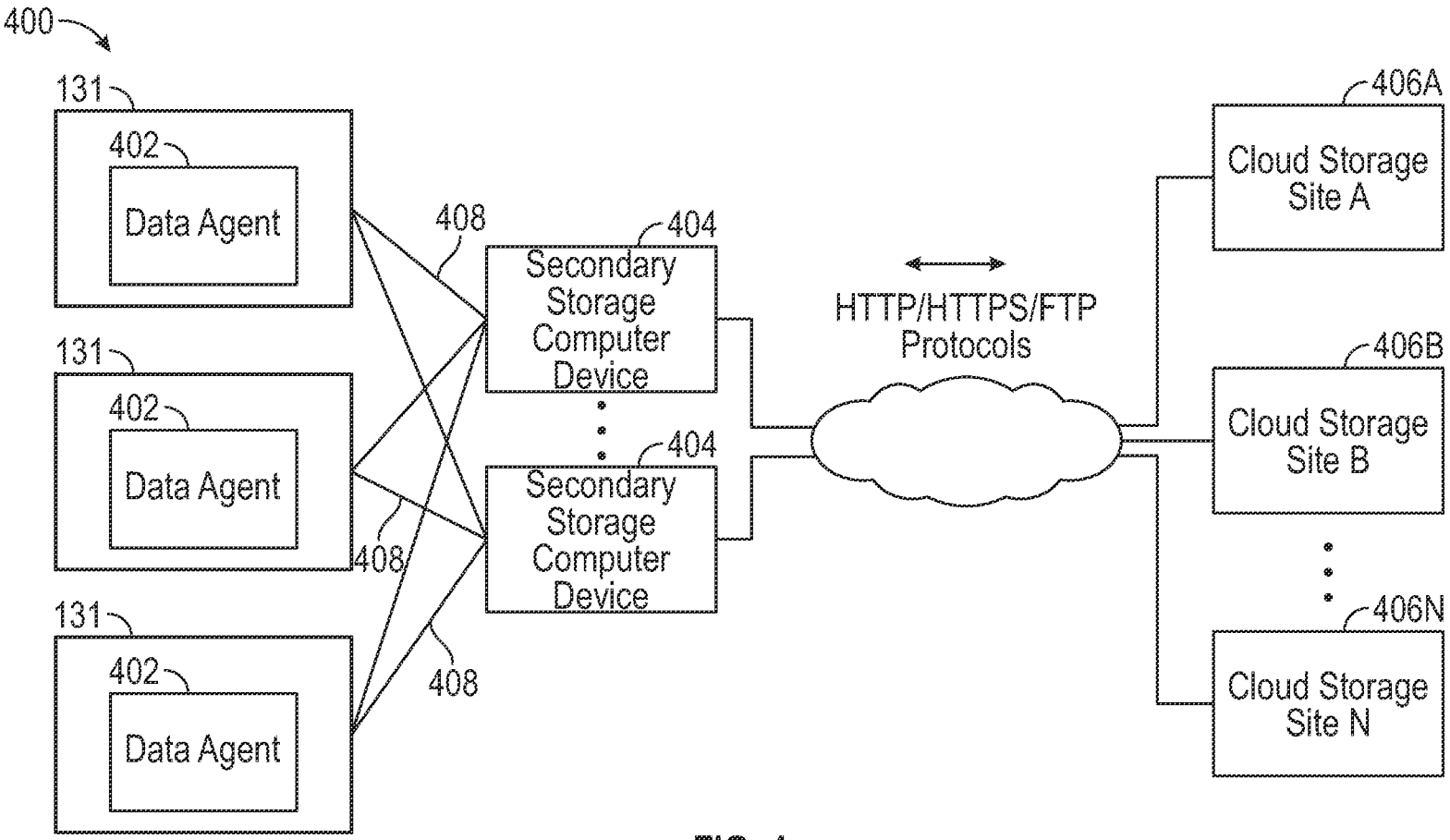
FIG. 4 illustrates a schematic view of a network.

FIG. 4 illustrates an example of one arrangement of resources in a computing network 400 that may employ the processes and techniques described herein, although many others are of course possible. As noted above, an information handling system 131, as part of their function, may utilize data, which includes files, directories, metadata (e.g., access control list (ACLS) creation/edit dates associated with the data, etc.), and other data objects. The data on the information handling system 131 is typically a primary copy (e.g., a production copy). During a copy, backup, archive or other storage operation, information handling system 131 may send a copy of some data objects (or some components thereof) to a secondary storage computing device 404 by utilizing one or more data agents 402.

A data agent 402 may be a desktop application, website application, or any software-based application that is run on information handling system 131. As illustrated, information handling system 131 may be disposed at any rig site (e.g., referring to FIG. 1) or repair and manufacturing center. The data agent may communicate with a secondary storage computing device 404 using communication protocol 408 in a wired or wireless system. The communication protocol 408 may function and operate as an input to a website application. In the website application, field data related to pre- and post-operations, generated DTCs, notes, and the like may be uploaded. Additionally, information handling system 131 may utilize communication protocol 408 to access processed measurements, operations with similar DTCs, troubleshooting findings, historical run data, and/or the like. This information is accessed from secondary storage computing device 404 by data agent 402, which is loaded on information handling system 131.

Secondary storage computing device 404 may operate and function to create secondary copies of primary data objects (or some components thereof) in various cloud storage sites 406A-N. Additionally, secondary storage computing device 404 may run determinative algorithms on data uploaded from one or more information handling systems 131, discussed further below. Communications between the secondary storage computing devices 404 and cloud storage sites 406A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 406A-N, the secondary storage computing device 404 may also perform local content indexing and/or local object-level, sub-object-level or block-level deduplication when performing storage operations involving various cloud storage sites 406A-N. Cloud storage sites 406A-N may further record and maintain DTC code logs for each downhole operation or run, map DTC codes, store repair and maintenance data, store operational data, and/or provide outputs from determinative algorithms and or models that are located in cloud storage sites 406A-N. In a non-limiting example, this type of network may be utilized as a platform to store, backup, analyze, import, and perform extract, transform and load ("ETL") processes to the data gathered during a drilling operation. In further examples, this type of network may be utilized to execute a hybrid data generator to generate an initial and/or an updated drilling program.

As previously mentioned, the hybrid data generator may include a stack of models which are run in series, in parallel, or combinations thereof to produce a drilling program. The development of drilling programs, whether executed using a hybrid data generator or using traditional methods, may require the analysis of text-based data. Additionally, the drilling programs (e.g., an output from a hybrid data generator) themselves may include text-based data. In some examples, Large Language Models may be proficient in analyzing input provided in the form of text, while providing an output in the form of text. As such, a Large Language Model may be included in the stack of models which form the hybrid data generator. In some examples, Large Language Models may be trained on large amounts of text data including but not limited to books, technical papers, articles, previous drilling reports, web-based content, emails, technical presentations, and various other forms of text-based data. In some examples, a Large Language Model algorithm may include a deep learning architecture which may be referred to as a transformer architecture. The transformer architecture may allow for a language model to perform natural language processing tasks in a fashion that mimics human-like responses. In some examples, tasks performed by natural language processing may include text-based content creation and generation, next-word predictions in sentence construction, summarization, machine translation, application (e.g., computer-based "apps") generation, and/or answering text-based questions with text-based responses. In further examples, large language models supported by transformer architecture may be able to learn the patterns and structures of language.

Figure 5:
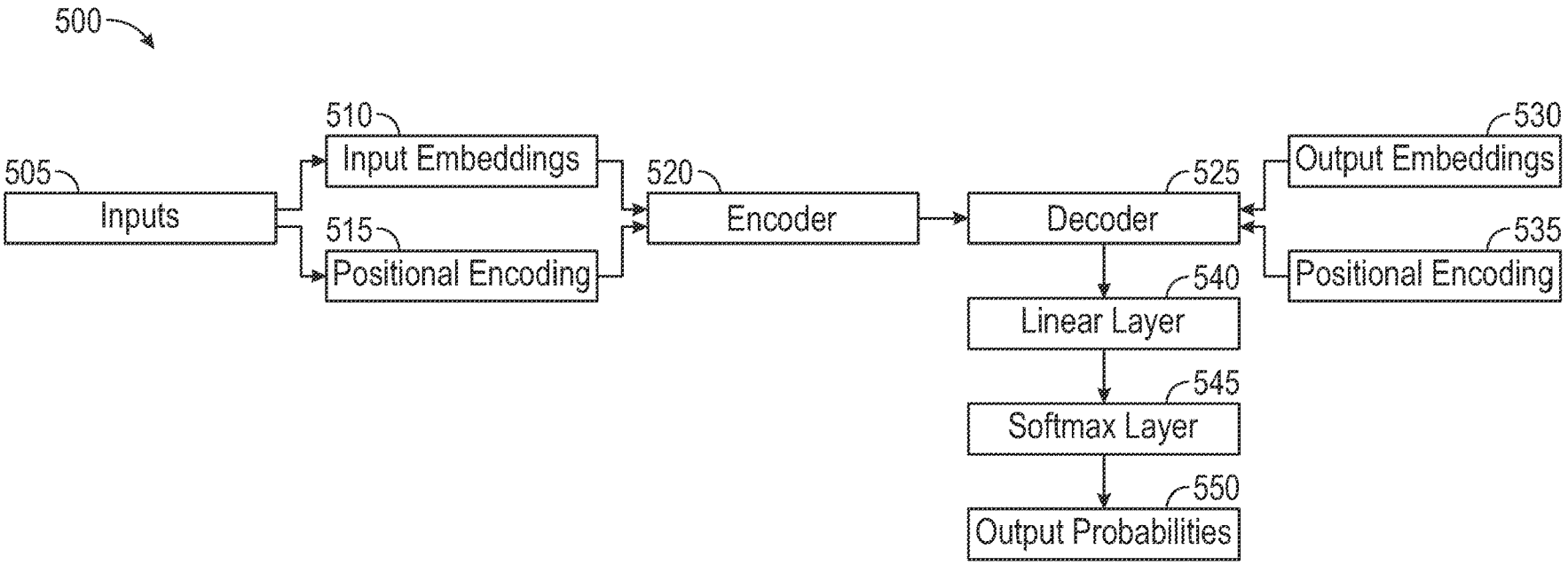
FIG. 5 illustrates a schematic view of transformer architecture.

FIG. 5 illustrates one example of a transformer architecture 500 which may be executed on an information handling system (e.g., information handling system 131 in FIG. 1) which may further be able to generate a model capable of performing natural language processing tasks. Transformer architecture 500 may include block 505 where one or more inputs are provided to transformer architecture 500. In some examples, the one or more inputs provided in block 505 may be provided in text-form, numerical-form, or combinations thereof. The one or more inputs provided in block 505 may be tokenized into distinct elements which may be referred to as tokens. In some examples, a tokenized sentence is a fixed-length sentence. In further examples, the tokenized sentence may further include words and/or sub-words. However, information handling systems may not be able to understand text-based tokens and therefore, may convert or transform the text-based tokens into a numerical format which may be referred to as input embeddings. For example, the tokens may be converted to integer indices associated with a vocabulary dataset. In block 510, the one or more inputs from block 505 may be translated into input embeddings. In some examples, input embeddings may represent words in a numerical format which may be processed by a machine learning algorithm and/or a machine learning model. In further examples, the input embeddings of block 510 may place the tokenized inputs of block 505 in a mathematical space such that words are placed in proximity to each other relative to their similarity. For example, the input embeddings may create vectors to associate words of similar meaning, which may further determine the location of the tokenized inputs from block 505 in the mathematic space. As such, the inputs may be tokenized, encoded in a numerical format, and converted to input embeddings where the tokens are placed in a vector-space representation to preserve their meaning.

In block 515, positional encoding may be applied to the inputs of block 505 to construct a sequence of embedding vectors. In some examples, each vector may represent the semantics and position of each token. As such, positional encoding may include encoding the sequential location or position of each word from the one or more inputs of block 505 as a set of numbers. In some examples, providing the sequential location of the words from the input as a positional encoding may allow the transformer architecture to more effectively understand how humans construct and order sentences. Additionally, the positional encoding may benefit the transformer architecture's ability to generate grammatically correct sentences with semantically meaningful responses. The positional encoding, which identifies the location of each word in the inputs may further be provided to an encoder in block 520 along with the input embeddings of block 510. The encoder of block 520 may be part of a neural network that processes the input embeddings and positional encodings of block 510 and block 515. In some examples, the encoder of block 520 may generate a series of hidden states that may capture the meaning and context of the input provided in block 505. In some examples, the encoder of block 520 may generate a series of hidden states that represent the input text at multiple levels of abstraction. In some examples, multiple layers of the encoder may be utilized in a transformer architecture. Additional information about the encoder structure will be detailed below.

The outputs from the encoder of block 520, which may include an encoded output sequence, may be provided to a decoder of block 525. A decoder may be part of a neural network that processes an encoded output sequence to generate a decoded output sequence. In some examples, the decoder of 525 may be trained to learn how to guess the next word in an output sequence based on the words that preceded the word to be guessed. In further examples, multiple layers of the decoder may be utilized in a transformer architecture. In addition to the encoded output sequence provided by the encoder of block 520, the decoder of block 525 may also receive output embeddings of block 530 and positional encoding of block 535 as inputs. In some examples, the positional encoding of block 535 may include an output sequence which is shifted to the right by one position. Since the information handling systems may not be able to understand text directly, the output sequence provided by the positional encoding of block 535 may be formatted as output embeddings. In some examples, a loss function may be utilized to adjust the output embeddings and positional encoding of block 530 and block 535. During the model training process, output embeddings may compute the loss function and update the model parameters to improve the difference between the model's predictions and the actual target values (e.g., model performance). During inference, the output embeddings may generate the output text by mapping the model's predicted probabilities of each token to one or more corresponding tokens in the vocabulary. Additional information about the decoder structure will be detailed below.

The decoded output sequence determined in block 525 may be provided to a linear layer in block 540. In some examples, a linear layer may map the decoded output sequence to a higher-dimensional space which may transform the decoded output sequence to the original input space. The output created from block 540 may be provided to a softmax function in block 545 which may generate a probability distribution for each output token in a vocabulary. The softmax function of block 545 may additionally generate output tokens with probabilities, such as the output probabilities of block 550.

As described above, the transformer architecture of FIG. 5 may include an encoder. An example schematic of the structure for an encoder may be illustrated in FIG. 6 with encoder architecture 600. The input embeddings and positional encodings (e.g., from block 510 and block 515 of FIG. 5) may be provided to a multi-head attention in block 610. In some examples the multi-head attention may include a self-attention mechanism to enrich the embedding vectors with contextual information from the whole sentence (e.g., from the inputs). For example, depending on the proximity of the words in a sentence, the words may have more than one semantic and/or functional purpose. By utilizing the self-attention mechanism, the model may be able to assess multiple embedding subspaces. In some examples, the multi-head attention may utilize eight or more parallel attention calculations.

The outputs from the multi-head attention in block 610 may be provided as inputs to the position-wise feed-forward network of block 615. The feed-forward network of block 615 may include one or more linear layers which may further include a rectified linear unit ("ReLU") activation function. In some examples, ReLU may introduce non-linearity to the feed-forward network to resolve a vanishing gradient issue. The position-wise feed-forward network may process each embedding vector independently with identical weights to provide further transformation of the embedding vectors. In some examples, the linear transformations may be equivalent across different positions, however they may use different parameters from a preceding linear layer to a subsequent linear layer. Encoder architecture 600 may include multiple layers of multi-attention heads and feed-forward networks, where the encoder uses residual connections and layer normalization 620. In some examples, residual connections between each layer may perform element-wise addition to carry over the previous embeddings to subsequent layers. In further examples, this may allow the encoder to enrich the embeddings vectors with additional information obtained from the outputs of the multi-head attention of block 610 and the feed-forward network of block 615. Layer normalization may also be applied after each layer, in conjunction with the application of residual connections. In some examples, layer normalization may reduce the effect of covariant shift. In some examples, reducing covariant shift may prevent migration of the mean and standard deviation of embedding vector elements. Encoder architecture 600 may only depict a single multi-head attention layer and a single position-wise feed forward layer, however, any number of multi-head attention layers and/or position-wise feed forward layers may be utilized in an encoder architecture. In such examples, the outputs from a preceding layer become the inputs to a subsequent layer. As such, multiple layers of residual connection and layer normalization may be utilized in association with the multi-head attention layers and position-wise feed forward layers.

As described above, the transformer architecture of FIG. 5 may include a decoder. An example schematic of the structure for a decoder may be illustrated in FIG. 7 with decoder architecture 700. In some examples, the input to decoder architecture 700 may be an output from the encoder (e.g., encoder architecture 600 of FIG. 6) with a positional encoding that is shifted to the right. In some examples, decoders may be similar to encoders in that they generate enriched embeddings. In block 705, inputs may be provided to a masked multi-head attention in block 710. In some examples, the inputs of block 705 may be the outputs from the encoder with positional encoding adjusted to the right. The mask-aspect of the masked multi-head attention may hide or mask certain information provided in the inputs of block 705. In some examples, when a mask is applied to a set of inputs, the masked inputs may not be usable to the multi-head attention of masked multi-head attention in block 710. The information to be masked may be determined by position. The masked multi-attention head in block 710 may include self-attention mechanisms to enrich the non-masked embedding vectors with contextual information from the unmasked portion of the sentence. As with the decoder architecture, the outputs from the masked multi-head attention in block 710 may pass through residual connection and layer normalization in block 715. As previously described, layer normalization may reduce the effect of covariant shift. In some examples, reducing covariant shift may prevent migration of the mean and standard deviation of embedding vector elements. Additionally, residual connections between each layer may perform element-wise addition to carry over the previous embeddings to subsequent layers. The outputs from block 715 may be provided as inputs to the multi-head attention layer in block 720 which may function substantially similar to the multi-head attention layer from the encoder architecture (e.g., encoder architecture 600 in FIG. 6). The outputs from block 720 may pass through residual connection and layer normalization in block 715 to provide inputs for position-wise feed forward in block 725. The position-wise feed forward layer in block 725 may function substantially similar to the position-wise feed forward layer from the encoder architecture (e.g., encoder architecture 600 in FIG. 6) before going being passed back through residual connection and layer normalization in block 715.

Figure 6:
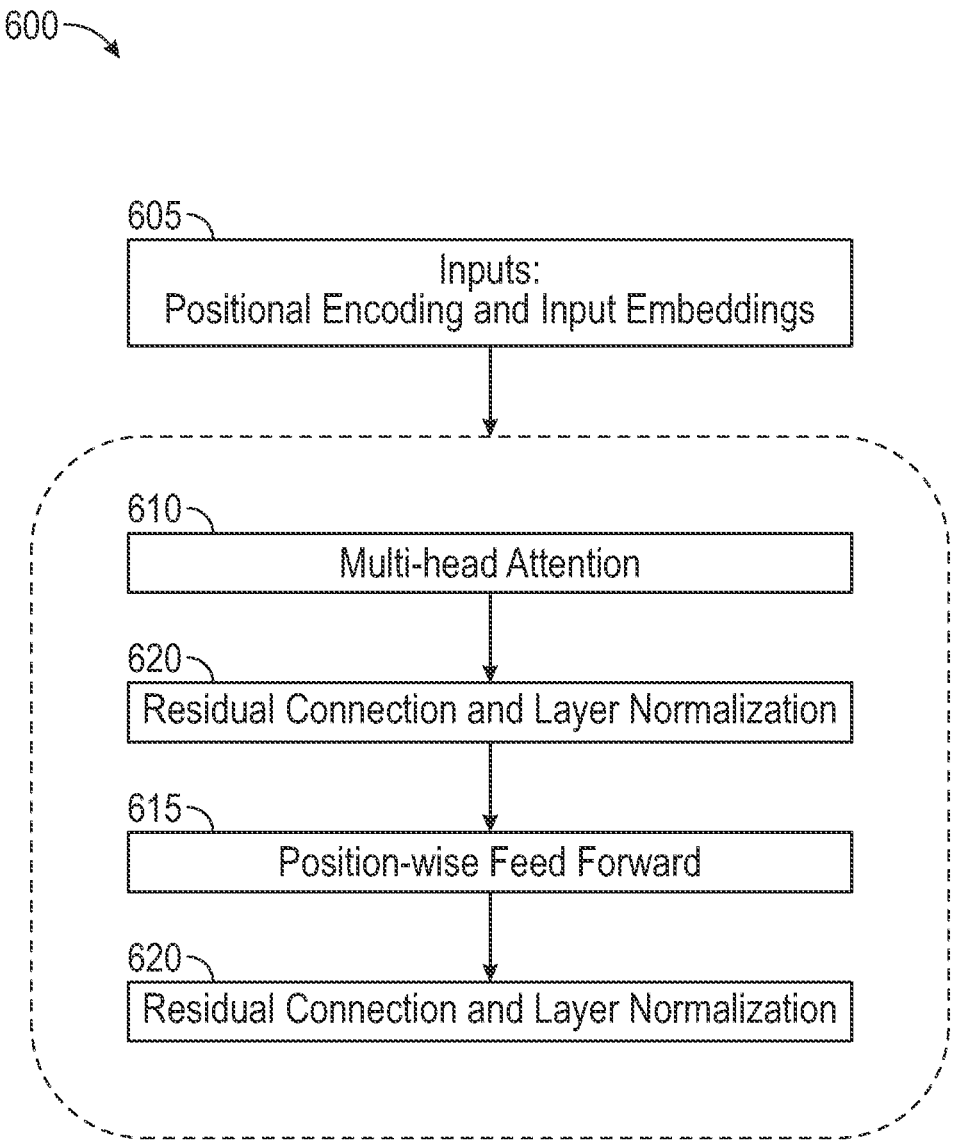
FIG. 6 illustrates a schematic view of an encoder.
Figure 7:
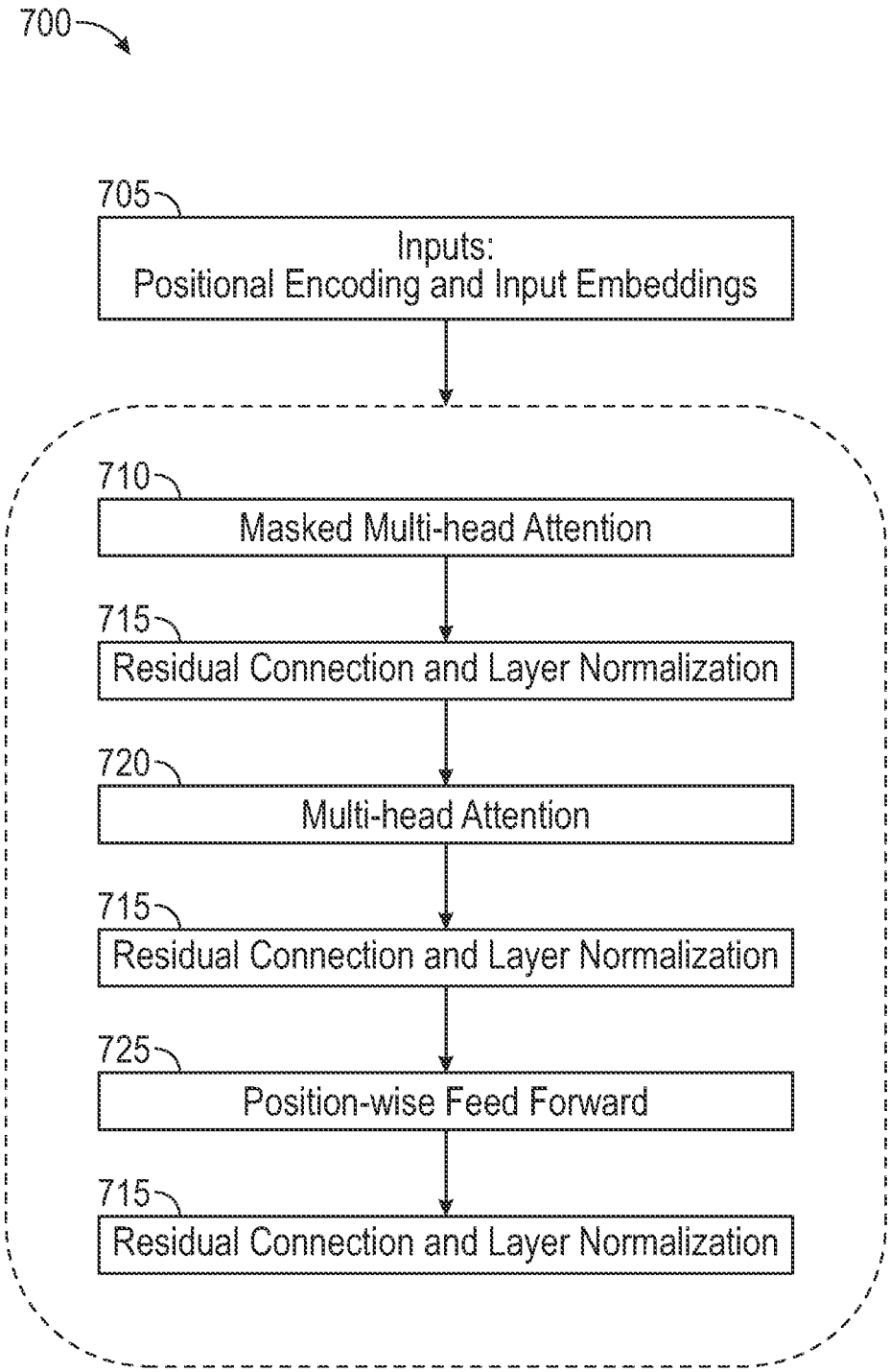
FIG. 7 illustrates a schematic view of a decoder.

The encoder of FIG. 6 and the decoder of FIG. 7 may utilize machine learning algorithms and deep learning algorithms to create a machine learning model which may be utilized in a transformer architecture. In some examples, the deep learning algorithms may include convolutional neural networks, long short term memory networks, recurrent neural networks, generative adversarial networks, attention neural networks, zero-shot models, fine-tuned models, domain-specific models, multi-modal models, transformer architectures, radial basis function networks, multilayer perceptrons, self-organizing maps, deep belief networks, and combinations thereof. Additionally, one or more of the empirical models incorporated in the stack of models which form the hybrid data generator may be developed from a machine learning algorithm. As such, the hybrid data generator may include additional machine learning-based models aside from the Large Language Model. A machine learning model may be an empirically derived model which may result from a machine learning algorithm identifying one or more underlying relationships within a dataset. In comparison to a physics-based model, which may be derived from first principals and define the mathematical relationship of a system, a pure machine learning model may not be derived from first principals. Once a machine learning model is developed, it may be queried in order to predict one or more outcomes for a given set of inputs. The type of input data used to query the model to create the prediction may correlate both in category and type to the dataset from which the model was developed. In the case of Large Language Models, the inputs utilized to query the model may not be an exact match to the dataset on which the model is trained.

The structure of, and the data contained within a dataset provided to a machine learning algorithm may vary depending on the intended function of the resulting machine learning model. In some examples, the data provided in a dataset may contain one or more independent values. The independent values of a dataset may be referred to as "features," and a collection of features may be referred to as a "feature space." Additionally, datasets may contain corresponding dependent values. The dependent values may be the result or outcome associated with a set of independent values. In some examples, the dependent values may be referred to as "target values." Although dependent values may be a necessary component of a dataset for certain algorithms, not all algorithms require a dataset with dependent values. Furthermore, both the independent and dependent values of the dataset may comprise either numerical, categorical, or text-based data.

While it may be true that machine learning model development is more successful with a larger dataset, it may also be the case that the whole dataset is not used to train the model. A test dataset may be a portion of the original dataset which is not presented to the algorithm for model training purposes. Instead, the test dataset may be used for what may be known as "model validation," which may be a mathematical evaluation of how successfully a machine learning algorithm has learned and incorporated the underlying relationships within the original dataset into a machine learning model. This may comprise evaluating model performance according to whether the model is over-fit or under-fit. As it may be assumed that all datasets contain some level of error, it may be important to evaluate and optimize the model performance and associated model fit by means of model validation. In general, the variability in model fit (e.g.: whether a model is over-fit or under-fit) may be described by the "bias-variance trade-off." As an example, a model with high bias may be an under-fit model, where the developed model is over-simplified, and has either not fully learned the relationships within the dataset or has over-generalized the underlying relationships. A model with high variance may be an over-fit model which has overlearned about non-generalizable relationships within training dataset which may not be present in the test dataset. In a non-limiting example, these non-generalizable relationships may be driven by factors such as intrinsic error, data heterogeneity, and the presence of outliers within the dataset. The selected ratio of training data to test data may vary based on multiple factors, including, in a non-limiting example, the homogeneity of the dataset, the size of the dataset, the type of algorithm used, and the objective of the model. The ratio of training data to test data may also be determined by the validation method used, wherein some non-limiting examples of validation methods comprise k-fold cross-validation, stratified k-fold cross-validation, bootstrapping, leave-one-out cross-validation, resubstitution, random sub-sampling, and percentage hold-out.

In some examples, training Large Language Models may include a training component referred to as reinforcement learning. In further examples, reinforcement learning may utilize human input, computer input (e.g., artificial intelligence), and combinations thereof. In some examples, reinforcement learning may include querying a trained model to receive one or more responses and ranking and quality and correctness of the one or more responses provided by the model. In further examples, the responses may be approved or rejected. In some examples, the assessment of the model-developed responses may be provided to the model in order to further train the model and improve the subsequent responses.

In addition to the parameters that exist within the dataset, such as the independent and dependent variables, machine learning algorithms may also utilize parameters referred to as "hyperparameters." Each algorithm may have an intrinsic set of hyperparameters which guide what and how an algorithm learns about the training dataset by providing limitations or operational boundaries to the underlying mathematical workflows on which the algorithm functions. Furthermore, hyperparameters may be classified as either model hyperparameters or algorithm parameters.

Model hyperparameters may guide the level of nuance with which an algorithm learns about a training dataset, and as such model hyperparameters may also impact the performance or accuracy of the model that is ultimately generated. Modifying or tuning the model hyperparameters of an algorithm may result in the generation of substantially different models for a given training dataset. In some cases, the model hyperparameters selected for the algorithm may result in the development of an over-fit or under-fit model. As such, the level to which an algorithm may learn the underlying relationships within a dataset, including the intrinsic error, may be controlled to an extent by tuning the model hyperparameters.

Model hyperparameter selection may be optimized by identifying a set of hyperparameters which minimize a predefined loss function. An example of a loss function for a supervised regression algorithm may include the model error, wherein a selected set of hyperparameters correlates to a model which produces the lowest difference between the predictions developed by the produced model and the dependent values in the dataset. In addition to model hyperparameters, algorithm hyperparameters may also control the learning process of an algorithm, however algorithm hyperparameters may not influence the model performance. Algorithm hyperparameters may be used to control the speed and quality of the machine learning process. As such, algorithm hyperparameters may affect the computational intensity associated with developing a model from a specific dataset.

Machine learning algorithms, which may be capable of capturing the underlying relationships within a dataset, may be broken into different categories. One such category may comprise whether the machine learning algorithm functions using supervised, unsupervised, semi-supervised, or reinforcement learning. The objective of a supervised learning algorithm may be to determine one or more dependent variables based on their relationship to one or more independent variables. Supervised learning algorithms are named as such because the dataset comprises both independent and corresponding dependent values where the dependent value may be thought of as "the answer," that the model is seeking to predict from the underlying relationships in the dataset. As such, the objective of a model developed from a supervised learning algorithm may be to predict the outcome of one or more scenarios which do not yet have a known outcome. Supervised learning algorithms may be further divided according to their function as classification and regression algorithms. When the dependent variable is a label or a categorical value, the algorithm may be referred to as a classification algorithm. When the dependent variable is a continuous numerical value, the algorithm may be a regression algorithm. In a non-limiting example, algorithms utilized for supervised learning may comprise Neural Networks, K-Nearest Neighbors, Naïve Bayes, Decision Trees, Classification Trees, Regression Trees, Random Forests, Linear Regression, Support Vector Machines (SVM), Gradient Boosting Regression, Genetic Algorithm, and Perception Back-Propagation.

The objective of unsupervised machine learning may be to identify similarities and/or differences between the data points within the dataset which may allow the dataset to be divided into groups or clusters without the benefit of knowing which group or cluster the data may belong to. Datasets utilized in unsupervised learning may not comprise a dependent variable as the intended function of this type of algorithm is to identify one or more groupings or clusters within a dataset. In a non-limiting example, algorithms which may be utilized for unsupervised machine learning may comprise K-means clustering, K-means classification, Fuzzy C-Means, Gaussian Mixture, Hidden Markov Model, Neural Networks, and Hierarchical algorithms.

Figure 8:
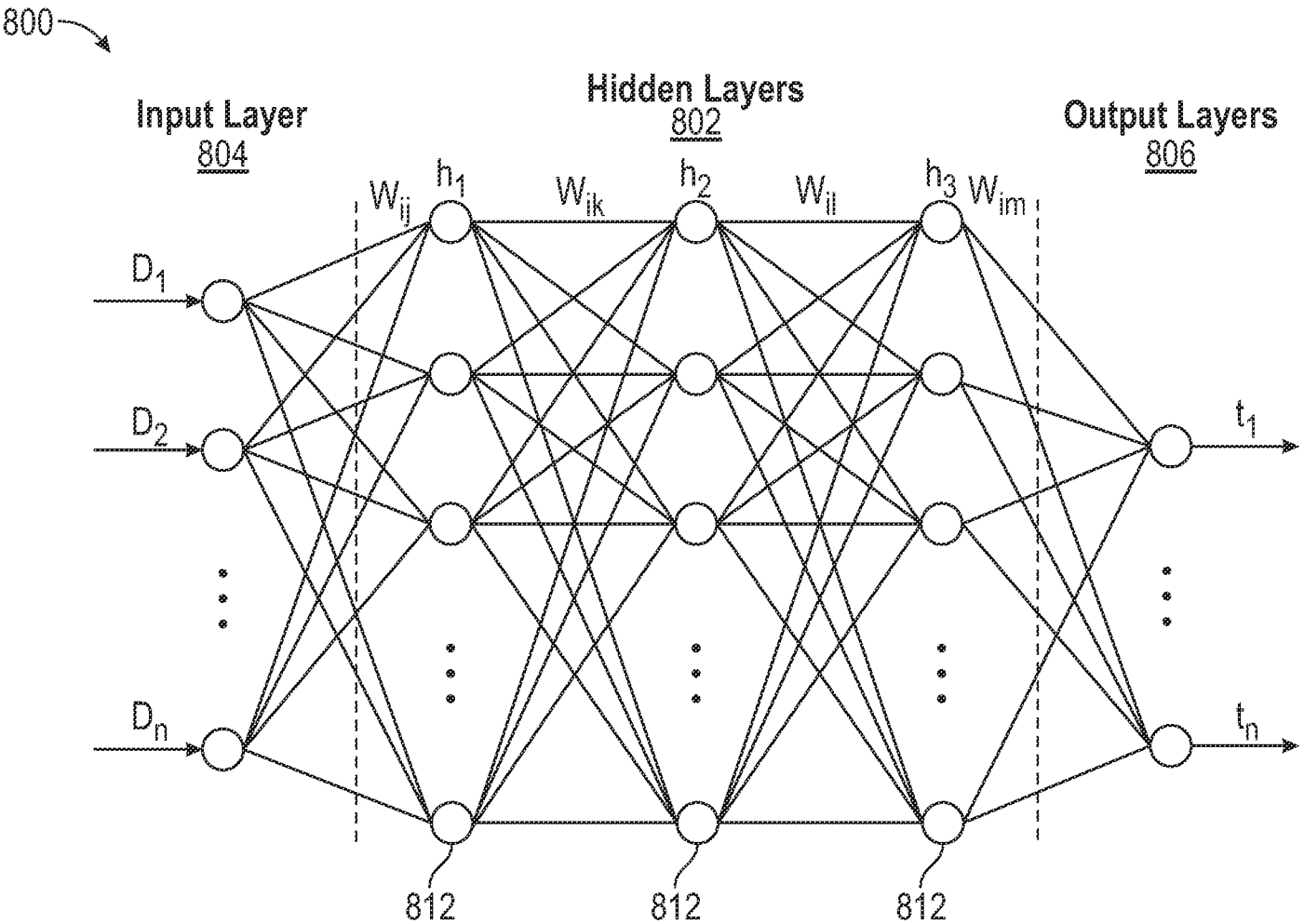
FIG. 8 illustrates a schematic of a machine learning algorithm which may be used for deep learning.

The machine learning algorithms utilized in a Large Language Model which may utilize transformer architecture as described in FIGS. 5-7 may include one or more neural network algorithms as illustrated in FIG. 8. In addition to the Large Language Model, the hybrid data generator may additionally include other machine learning-based models which may work in conjunction with the Large Lange Model. For example, the hybrid data generator may include models based on Gaussian Mixture Models, Hidden Markov Models, Support Vector Machines, Principal Component Analysis ("PCA") models built on a variety of neural networks. Examples of machine learning algorithms that fall into the category of neural networks may comprise Perceptron, Multi-Layer Perceptron, Feed Forward, Radial Basis Network, Deep Feed Forward, Recurrent Neural Network, Long Term Memory, Short Term Memory, Deep Neural Network, Gated Recurrent Unit, Auto Encoder, Variational AE, Denoising AE, Sparse AE, Markov Chain, Hopfield Network, Boltzmann Machine, Restricted Boltzmann Machine, Deep Belief Network, Deep Convolutional Network, Deconvolutional Network, Deep Convolutional Inverse Graphics Network, Generative Adversarial Network, Liquid State Machine, Extreme Learning Machine, Echo State Network, Deep Residual Network, Kohonen Network, Support Vector Machine, and Neural Turing Machine. Neural network 800 of FIG. 8 may be utilized to draw a relationship between independent and dependent variables, or to identify relationships within a set of exclusively independent variables as described herein. Neural network 800 may be an artificial neural network with one or more hidden layers 802 between input layer 804 and output layer 806. As illustrated, input layer 804 may include multi-disciplinary datasets as described in the foregoing, whereas output layers 806 may include data which may further feed the model stack, or may provide outputs used to populate a drilling program. As such, the outputs from neural network 800 may provide results which are directly included in the drilling program, or may function as inputs to a subsequent model or series of models which may then provide results which may be included in the drilling program. Input data is taken by neurons 812 in first layer which then provide an output to the neurons 812 within next layer and so on which provides a final output in output layer 806. Each layer may have one or more neurons 812. The connection between two neurons 812 of successive layers may have an associated weight. The weight defines the influence of the input to the output for the next neuron 812 and eventually for the overall final output. The process of training the neural network may entail determining the suitable weights that produce a model capable of being utilized in a hybrid data generator to generate one or more drilling programs. Furthermore, building the machine learning model may be an iterative process which comprises a validation component and/or reinforcement learning, as previously mentioned. Once a model which meets one or more criterion for deployment, which in a non-limiting example may comprise achieving a certain level of accuracy, it may be incorporated into a hybrid data generator to generate one or more drilling programs. In some examples, the level of accuracy which meets the deployment criterion may range from about 50% to about 100%. Alternatively, the level of accuracy may range from about 50% to about 60%, about 60% to about 70%, about 70% to about 80%, about 80% to about 90%, or about 90% to about 100%. Finally, if the historical dataset, which may further comprise multi-disciplinary datasets, increases in size due to the acquisition of additional data, the model may be retrained to incorporate the learnings of the additional data. In some examples, data generated by a hybrid data generator may additionally be incorporated into the dataset to augment the training dataset.

Figure 9:
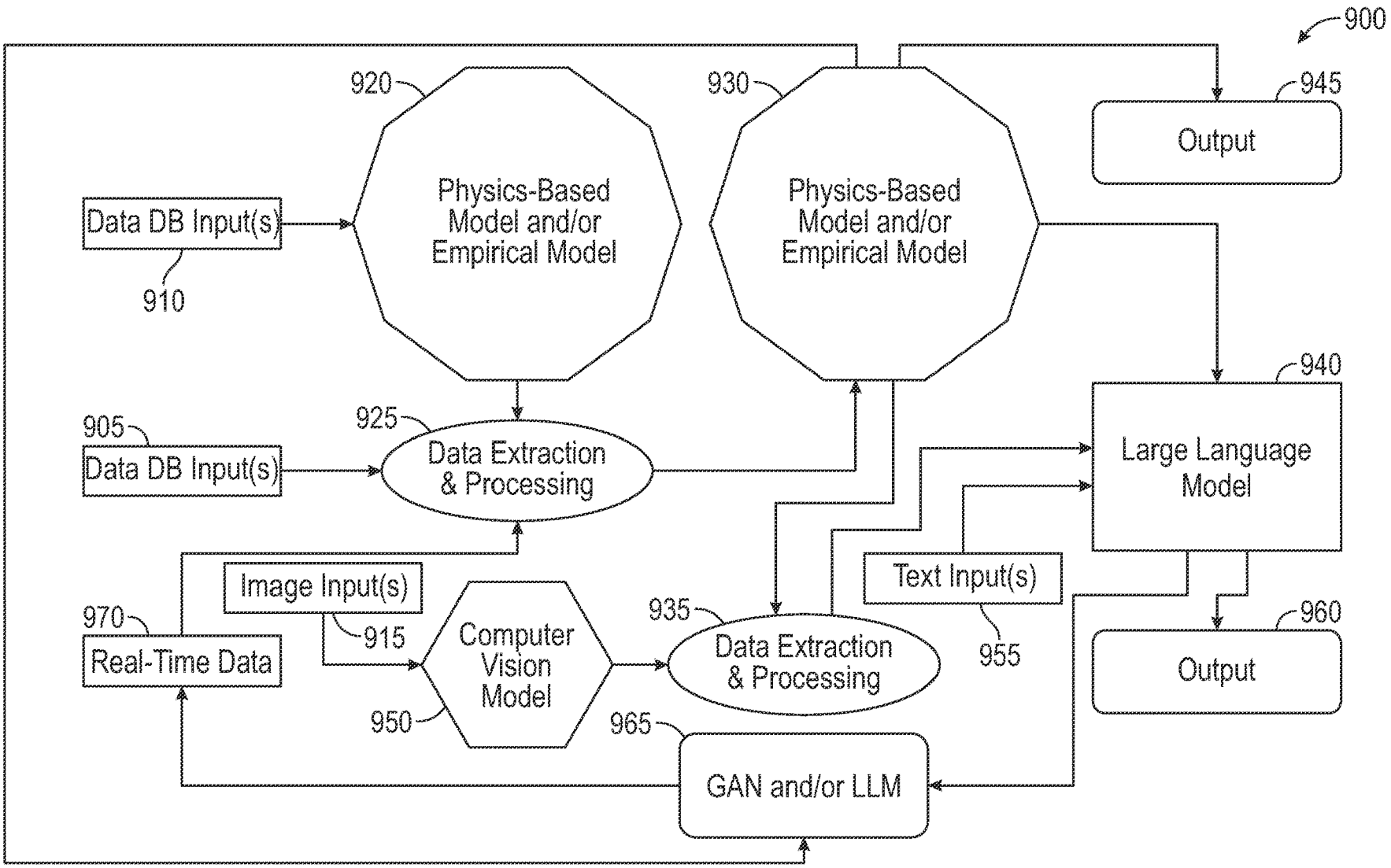
FIG. 9 illustrates a hybrid data generator which incorporates deep learning and a physical-model.

The machine learning models and Large Language Models as described in the foregoing may be incorporated into the stack of models which forms a hybrid data generator which may be further described in FIG. 9. A hybrid data generator 900 of FIG. 9 may include a stack of models which may be executed in series, in parallel, and combinations thereof. The stack of models in hybrid data generator 900, which may further include machine learning models and deep learning models, may receive inputs from block 905, block 910, and block 915. In some examples, the inputs supplied in block 905 and block 910 may include a dataset which may further include historical data from multi-disciplinary datasets. For example, data gathered from previously performed drilling operations may be included in a historical multi-disciplinary dataset. In some examples, the datasets included in the inputs supplied in block 905 and block 910 may include public datasets or public databases as previously described (e.g., weather and/or traffic related data). In some examples, the inputs may additionally include data from previously generated drilling programs. These drilling programs may include drilling programs generated by personnel, drilling programs generated by a hybrid data generator, and combinations thereof. In some examples, the inputs supplied in block 915 may include image data which may further include path referencing image storage, wellbore logging images, formation images from wellbore image logs, process implementation schematics, wellsite configuration schematics, seismic images, microseismic images, pdfs or text-based images from previous wellbore construction reports (e.g., daily reports or operational reports), and images of previous drilling programs.

The dataset included in the inputs of block 910 may be provided to one or more models in block 920. The models of block 920 may include physics-based models, empirically derived models, and combinations thereof. For example, the models of block 920 may include any combination of physics-based models, physics-informed neural networks ("PINNs"), deep learning models, machine learning models, Gaussian Mixture Models, Hidden Markov Models, Support Vector Machine Models, Principal Component Analysis Models, and combinations thereof. The outputs of block 920 may provide for inputs to block 925 where data extraction and data processing may occur. In some examples, the outputs of block 920 may undergo an Extract, Transform, and Load ("ETL") process which may identify relevant data, process it, and perform any transformations prior to providing the data to block 930. In some examples, the ETL process may identify a subset of relevant data from a larger dataset and create a data subset for utilization in the hybrid data generator. In some examples, ETL processes may be considered a component of "data cleaning," which may organize, partition, structure, and standardize an unorganized dataset into a cohesive dataset. Generating a cohesive dataset may be beneficial if the dataset is to be utilized for machine learning and/or deep learning processes. The ETL process in block 925 may additionally utilize logic to determine how to handle null values in the dataset provided by block 920. In some examples, the ETL processes may time-align or depth-align data contained in two distinct databases which may further be processed prior to utilization in block 930.

In addition to receiving the output dataset from block 920, block 925 may also receive the inputs supplied in block 905. The same or substantially similar ETL processes which were applied to the dataset of block 920 may likewise be applied to the dataset from block 905. In some examples, the dataset provided by block 920 and the dataset provided by block 905 may be joined into a cohesive dataset prior to being supplied to block 930. In other examples, the dataset from block 905 undergo separate ETL processes from the dataset of block 920 in order to maintain two distinct datasets which may be handled separately by block 930.

In block 930, the one or more datasets received from block 925 may be provided as inputs to one or more models. As previously mentioned, block 925 may receive a cohesive dataset when the outputs from block 920 and inputs from block 905 are joined into a single dataset. However, block 930 may additionally receive separate datasets from block 925, where the ETL processes on block 920 and block 905 are performed separately. The models of block 930 may include physics-based models, empirically derived models, and combinations thereof. For example, the models of block 920 may include any combination of physics-based models, physics-informed neural networks ("PINNs"), deep learning models, machine learning models, Gaussian Mixture Models, Hidden Markov Models, Support Vector Machine Models, Principal Component Analysis Models, and combinations thereof.

In some examples, the outputs of block 930 may provide for inputs to block 945 where results from the models in block 930 may be displayed in a multitude of formats including numerical, graphical, and image. The outputs from block 945 may further include reports, graphs, images, further data analytics, and data extraction. For example, the outputs from block 930 may provide results from one or more models including physics-based models and empirical models. In further examples, the results of these models may be analyzed, reviewed, and validated in block 945 to ensure that the model outputs track with an expected output.

In some examples, the outputs of block 930 may additionally provide for inputs to block 935 where the dataset may undergo additional data extraction and data processing. In some examples, the outputs of block 920 may undergo an Extract, Transform, and Load ("ETL") process which may identify relevant data, process it, and perform any transformations prior to providing the data to a Large Language Model in block 940. In some examples, the ETL process may identify a subset of relevant data from a larger dataset and create a data subset for utilization in the hybrid data generator. In some examples, ETL processes may be considered a component of "data cleaning," which may organize, partition, structure, and standardize an unorganized dataset into a cohesive dataset. Generating a cohesive dataset may be beneficial if the dataset is to be utilized for machine learning and/or deep learning processes. The ETL process in block 935 may additionally utilize logic to determine how to handle any null values in the dataset provided by block 930.

As previously mentioned, inputs in image-format or video-format may be received by hybrid data generator 900 in block 915. The one or more images of block 915 may be inputs to a computer vision model in block 950. In some examples, the image inputs may include path referencing image storage, wellbore logging images, formation images from wellbore image logs, process implementation schematics, wellsite configuration schematics, seismic images, microseismic images, portable document format files ("PDF") or text-based images from previous wellbore construction reports (e.g., daily reports or operational reports), and images of previous drilling programs. In some examples, a computer vision model may be able to translate visual data based on features and contextual information contained in the visual data. For example, computer vision models may be able to identify or detect objects, visual elements, or visual features within an image. In further examples, computer vision model algorithms may rely on convolutional neural networks and a multi-layered architecture along with a training dataset to construct the computer vision model. The output from block 950 may be provided as an input to block 935 where it may undergo data extraction and data processing. The output from the data extraction and data processing of block 935 may then be provided as an input to the Large Language Model of block 940.

As mentioned in the foregoing, the outputs from block 935 which may include be numerical outputs created by the one or more models of block 930, and the image related outputs created in block 950, may be supplied as inputs to the Large Language Model of block 940. In addition to these inputs, one or more text inputs of block 955 may be provided to the Large Language Model of block 940. These text inputs may include questions which may further include prompt engineering. In some examples, prompt engineering may include crafting a textual input for a Large Language Model with consideration for appropriate words, phrases, sentence structures, and problem formulation. The text inputs may also be crafted to benefit problem formulation which may further defining a problem for the Large Language Model to solve with consideration for delineating the problem focus, scope, and boundaries. The inputs provided to the Large Language Model of block 940 may be any combination or multiplicity of outputs from block 935 and block 955. The outputs from block 940 may feed into block 960 to form a final result which may include reports, graphs, images, data analytics, data extraction, and combinations thereof. In some examples, the reports of block 960 may include an initial drilling program or an updated drilling program.

One example of where an updated drilling program may be generated is when new data is acquired which was not present in the training dataset (e.g., the historical multi-disciplinary dataset). In further examples, new data may be obtained during operations on a given well or on an offset well. In some examples, the outputs of block 930, which may include numerical outputs from physics-based and machine learning-based models may be further provided to a Generative Adversarial Network and/or a Large Language Model in block 965. In further examples, the models of block 965 may be trained and utilized for making or updating decisions during real-time operations. The models developed in block 965 may be applied to one or more real-time datapoints in block 970. Similar to the other numerical inputs provided to hybrid data generator 900, the real-time data collected in block 970 may undergo an ETL process in block 925 before being utilized by the stacked models of hybrid data generator 900.

The proposed methods and systems may make use of multi-disciplinary datasets in conjunction with a hybrid generator to create one or more drilling programs in a faster and more efficient manner than previous processes have allowed for. In some examples, the hybrid data generators which utilize large language models may remove at least some of the manual work involved with creating drilling programs which may allow for humans to focus their time and effort on improving the quality of the drilling program over performing the manual tasks of developing the drilling programs. For example, human workers, including subject matter experts, may be able to shift their time from focusing on creating a single drilling program to assessing the potential effectiveness of an array of drilling programs. In further examples, human workers, including subject matter experts may be able to focus their work efforts on critical assessments and problem solving rather than merely developing a document which would require further assessment. In some examples, processes which may be very time consuming could consume less time which may allow for faster execution of a drilling program. For example, the development of drilling programs which previously may have required days to weeks of work may be reduced to fewer days or even a matter of hours. In further examples, changes experienced during a drilling operation could be incorporated into an updated drilling program with a decreased turn-around time. For example, the overall capability to access multitudes of information 'on the fly' or in real-time by simply querying a hybrid data generator which incorporates some level of predictive analytics allows for better planning, increased vigilance and may result in better efficiency in drilling operation. In some examples, data which may not have previously been incorporated into a drilling program could be included. In some examples, the addition of new data sources may result in an improved drilling program. In some examples, the utilization of hybrid data generators may improve knowledge sharing among various teams by connecting and/or incorporating previously disconnected data sources. For example, incorporating data gathered from previous wells and/or a variety of teams, which may not have previously been in communication, may allow for rapid knowledge sharing which may further allow for utilization of larger datasets when developing new and revised drilling programs. In some examples, hybrid data generators may allow for the system to access databases and pick input well data based on the location (distance from upcoming location), provide weather predictions, provide logistic limitations, and incorporate local laws that might significantly impact delivery of equipment/products.

The systems and methods may include any of the various features disclosed herein, including one or more of the following statements. The systems and methods may include any of the various features disclosed herein, including one or more of the following statements.

Statement 1. A method may comprise: providing one or more inputs to a hybrid data generator, wherein one or the one or more inputs is based at least in part on a wellsite location, wherein the hybrid data generator comprises a large language model, and wherein the large language model is based at least in part on a machine learning algorithm; utilizing an information handling system to generate a drilling program based at least in part on the one or more inputs and the hybrid data generator; performing at least a portion of a drilling operation based at least in part on the drilling program; and collecting at least one measurement from at least one sensor during the drilling operation.

Statement 2. The method of statement 2, wherein the large language model is trained using a dataset comprising at least one type of data selected from the group consisting of engineering data, geological data, geo-mechanical data, geo-physical data, data from lab-based tests, data modelled from simulations, data modelled from physics-based models, operational data from current drilling operations, operational data from previous drilling operations, measurements collected from current drilling operations, measurements collected from previous drilling operations, information collected from previous drilling reports, previously created drilling plans, logging data, public geological data, weather data, traffic data, road restriction data, and combinations thereof.

Statement 3. The method of statements 1 or 2, wherein the one or more inputs further comprises at least one input selected from the group consisting of engineering data, geological data, geo-mechanical data, geo-physical data, data from lab-based tests, data modelled from simulations, data modelled from physics-based models, operational data from current drilling operations, operational data from previous drilling operations, measurements collected from current drilling operations, measurements collected from previous drilling operations, information collected from previous drilling reports, previously created drilling plans, logging data, and combinations thereof.

Statement 4. The method of any preceding statements, 1 through 3, wherein training the large language model further comprises reinforcement learning.

Statement 5. The method of any preceding statements, 1 through 4, wherein the machine learning algorithm is utilized in a transformer architecture.

Statement 6. The method of statement 5, wherein the transformer architecture includes at least one architecture component selected from the group consisting of an encoder, a decoder, and combinations thereof.

Statement 7. The method of any of the preceding statements, 1 through 6, wherein the machine learning algorithm comprises a deep learning algorithm further comprising at least one type of algorithm selected from the group consisting of convolutional neural networks, long short term memory networks, recurrent neural networks, generative adversarial networks, attention neural networks, zero-shot models, fine-tuned models, domain-specific models, multi-modal models, transformer architectures, radial basis function networks, multilayer perceptrons, self-organizing maps, deep belief networks, and combinations thereof.

Statement 8. The method of any of the preceding statements, 1 through 7, further comprising updating the drilling program using the at least one measurement collected from the at least one sensor during the drilling operation, wherein the at least one measurement is added to the inputs provided to the hybrid data generator.

Statement 9. The method of statement 8, wherein updating the drilling program comprises updating the drilling program using at least one method selected from the group consisting of continuously updating the drilling program, updating the drilling program at set intervals of time, updating the drilling program when manually executed, updating the drilling program when a threshold is met, or combinations thereof.

Statement 10. The method of any of the preceding statements, 1 through 9, wherein the large language model is optimized for at least one operational feature, wherein the at least one operational feature is at least one feature selected from the group consisting of maximizing rate of penetration, maximizing hole cleaning, maximizing hole stability, minimizing total drilling cost, minimizing operational time per hole section, operational safety, minimizing cost per hole section, and combinations thereof.

Statement 11. A system comprising: a hybrid data generator comprising a large language model, wherein the large language model is based at least in part on a machine learning algorithm; an information handling system configured to execute the hybrid data generator to generate a drilling program, wherein the generated drilling program is based at least in part on one or more inputs and wherein at least one of the one or more inputs is based at least in part on a wellsite location; and a sensor in communication with the information handling system wherein the sensor measures at least one measurement during a drilling operation.

Statement 12. The system of statement 11, wherein the large language model is trained using a dataset comprising at least one type of data selected from the group consisting of engineering data, geological data, geo-mechanical data, geo-physical data, data from lab-based tests, data modelled from simulations, data modelled from physics-based models, operational data from current drilling operations, operational data from previous drilling operations, measurements collected from current drilling operations, measurements collected from previous drilling operations, information collected from previous drilling reports, previously created drilling plans, logging data, and combinations thereof.

Statement 13. The system of statements 11 or 12, wherein the one or more inputs further comprises at least one input selected from the group consisting of engineering data, geological data, geo-mechanical data, geo-physical data, data from lab-based tests, data modelled from simulations, data modelled from physics-based models, operational data from current drilling operations, operational data from previous drilling operations, measurements collected from current drilling operations, measurements collected from previous drilling operations, information collected from previous drilling reports, previously created drilling plans, logging data, and combinations thereof.

Statement 14. The system of any of the preceding statements, 11 through 13, wherein training the large language model further comprises reinforcement learning.

Statement 15. The system of any of the preceding statements, 11 through 14, wherein the machine learning algorithm is utilized in a transformer architecture.

Statement 16. The system of statement 15, wherein the transformer architecture includes at least one architecture component selected from the group consisting of an encoder, a decoder, and combinations thereof.

Statement 17. The system of any of the preceding statements, 11 through 16, wherein the machine learning algorithm comprises a deep learning algorithm further comprising at least one type of algorithm selected from the group consisting of convolutional neural networks, long short term memory networks, recurrent neural networks, generative adversarial networks, attention neural networks, zero-shot models, fine-tuned models, domain-specific models, multi-modal models, transformer architectures, radial basis function networks, multilayer perceptrons, self-organizing maps, deep belief networks, and combinations thereof.

Statement 18. The system of any of the preceding statements, 11 through 17, wherein the information handling system is configured to update the drilling program based at least in part on the one measurement collected by the sensor during the drilling operation.

Statement 19. The system of statement 18, wherein the information handling system is configured to update the drilling program using at least one method selected from the group consisting of continuously updating the drilling program, updating the drilling program at set intervals, updating the drilling program when manually executed, updating the drilling program when a threshold is met, or combinations thereof.

Statement 20. The system of any of the preceding statements, 11 through 19, wherein the large language model is optimized for at least one operational feature, wherein the at least one operational feature is at least one feature selected from the group consisting of maximizing rate of penetration, maximizing hole cleaning, maximizing hole stability, operational safety, minimizing total drilling cost, minimizing cost per hole section, minimizing operational time per hole section, and combinations thereof.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

crafting a text input that specifies:

a wellsite location;

geological data for the wellsite location; and a problem definition of a drilling program;

providing the text input to a hybrid data generator that comprises a large language model based on a machine learning algorithm;

initiating generation of the drilling program using the hybrid data generator, wherein the hybrid data generator uses input embeddings to process the text input, wherein the hybrid data generator uses text-based content creation, based on the input embeddings, to generate the drilling program, and wherein the drilling program comprises a borehole design based the geological data; and performing a drilling operation based on the borehole design.

2. The method of claim 1, wherein the large language model is fine-tuned using a dataset comprising at least one type of data selected from the group consisting of engineering data, the geological data, geo-mechanical data, geophysical data, data from lab-based tests, data modelled from simulations, data modelled from physics-based models, operational data from current drilling operations, operational data from previous drilling operations, measurements collected from current drilling operations, measurements collected from previous drilling operations, information collected from previous drilling reports, previously created drilling plans, logging data, public geological data, weather data, traffic data, road restriction data, and combinations thereof.

3. The method of claim 1, wherein the one or more inputs further comprises at least one input selected from the group consisting of engineering data, the geological data, geomechanical data, geo-physical data, data from lab-based tests, data modelled from simulations, data modelled from physics-based models, operational data from current drilling operations, operational data from previous drilling operations, measurements collected from current drilling operations, measurements collected from previous drilling operations, information collected from previous drilling reports, previously created drilling plans, logging data, and combinations thereof.

4. The method of claim 1, wherein training the large language model further comprises reinforcement learning.

5. The method of claim 1, wherein the machine learning algorithm is utilized in a transformer architecture.

6. The method of claim 5, wherein the transformer architecture includes at least one architecture component selected from the group consisting of an encoder, a decoder, and combinations thereof.

7. The method of claim 1, wherein the machine learning algorithm comprises a deep learning algorithm further comprising at least one type of algorithm selected from the group consisting of convolutional neural networks, long short term memory networks, recurrent neural networks, generative adversarial networks, attention neural networks, zero-shot models, fine-tuned models, domain-specific models, multimodal models, transformer architectures, radial basis function networks, multilayer perceptrons, self-organizing maps, deep belief networks, and combinations thereof.

8. The method of claim 1, further comprising updating the drilling program using a measurement collected from a sensor during the drilling operation, wherein the measurement is added to the text input provided to the hybrid data generator.

9. The method of claim 8, wherein updating the drilling program comprises updating the drilling program using at least one method selected from the group consisting of continuously updating the drilling program, updating the drilling program at set intervals of time, updating the drilling program when manually executed, updating the drilling program when a threshold is met, or combinations thereof.

10. The method of claim 1, wherein the large language model is optimized for at least one operational feature, wherein the at least one operational feature is at least one feature selected from the group consisting of maximizing rate of penetration, maximizing hole cleaning, maximizing hole stability, minimizing total drilling cost, minimizing operational time per hole section, operational safety, minimizing cost per hole section, and combinations thereof.

11. A system comprising:

an information handling system configured to execute a hybrid data generator that comprises a large language model based on a machine learning algorithm;

wherein executing the hybrid data generator comprises:

receiving a text input that specifies:

a wellsite location;

geological data for the wellsite location; and a problem definition of a drilling program;

using input embeddings to process the text input;

using text-based content creation based on the input embeddings; and generating the drilling program based on the text-based content creation, wherein the drilling program comprises a borehole design based the geological data; and a sensor in communication with the information handling system, wherein the sensor measures at least one measurement during a drilling operation.

12. The system of claim 11, wherein the large language model is fine-tuned using a dataset comprising at least one type of data selected from the group consisting of engineering data, the geological data, geo-mechanical data, geophysical data, data from lab-based tests, data modelled from simulations, data modelled from physics-based models, operational data from current drilling operations, operational data from previous drilling operations, measurements collected from current drilling operations, measurements collected from previous drilling operations, information collected from previous drilling reports, previously created drilling plans, logging data, and combinations thereof.

13. The system of claim 11, wherein the one or more inputs further comprises at least one input selected from the group consisting of engineering data, the geological data, geo-mechanical data, geo-physical data, data from lab-based tests, data modelled from simulations, data modelled from physics-based models, operational data from current drilling operations, operational data from previous drilling operations, measurements collected from current drilling operations, measurements collected from previous drilling operations, information collected from previous drilling reports, previously created drilling plans, logging data, and combinations thereof.

14. The system of claim 11, wherein training the large language model further comprises reinforcement learning.

15. The system of claim 11, wherein the machine learning algorithm is utilized in a transformer architecture.

16. The system of claim 15, wherein the transformer architecture includes at least one architecture component selected from the group consisting of an encoder, a decoder, and combinations thereof.

17. The system of claim 11, wherein the machine learning algorithm comprises a deep learning algorithm further comprising at least one type of algorithm selected from the group consisting of convolutional neural networks, long short term memory networks, recurrent neural networks, generative adversarial networks, attention neural networks, zero-shot models, fine-tuned models, domain-specific models, multimodal models, transformer architectures, radial basis function networks, multilayer perceptrons, self-organizing maps, deep belief networks, and combinations thereof.

18. The system of claim 11, wherein the information handling system is configured to update the drilling program based at least in part on the one measurement collected by the sensor during the drilling operation.

19. The system of claim 18, wherein the information handling system is configured to update the drilling program using at least one method selected from the group consisting of continuously updating the drilling program, updating the drilling program at set intervals, updating the drilling program when manually executed, updating the drilling program when a threshold is met, or combinations thereof.

20. The system of claim 11, wherein the large language model is optimized for at least one operational feature, wherein the at least one operational feature is at least one feature selected from the group consisting of maximizing rate of penetration, maximizing hole cleaning, maximizing hole stability, operational safety, minimizing total drilling cost, minimizing cost per hole section, minimizing operational time per hole section, and combinations thereof.

* * * * *